US008384643B2

(12) United States Patent
Hasegawa et al.

(10) Patent No.: US 8,384,643 B2
(45) Date of Patent: Feb. 26, 2013

(54) DRIVE CIRCUIT AND DISPLAY DEVICE

(75) Inventors: Hideaki Hasegawa, Ibaraki (JP); Kunihiro Harayama, Ibaraki (JP); Koji Higuchi, Ibaraki (JP); Atsushi Hirama, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 265 days.

(21) Appl. No.: 12/968,621

(22) Filed: Dec. 15, 2010

(65) Prior Publication Data

US 2011/0157120 A1 Jun. 30, 2011

(30) Foreign Application Priority Data

Dec. 28, 2009 (JP) ..... 2009-298120

(51) Int. Cl.
*G09G 3/36* (2006.01)

(52) U.S. Cl. ..... 345/98; 345/92; 345/96; 345/209; 345/211

(58) Field of Classification Search ..... 345/87–100, 345/204–210
See application file for complete search history.

(56) References Cited

U.S. PATENT DOCUMENTS

| | | | | |
|---|---|---|---|---|
| 6,049,321 | A * | 4/2000 | Sasaki | 345/99 |
| 6,529,180 | B1 * | 3/2003 | Ito et al. | 345/89 |
| 6,924,782 | B1 * | 8/2005 | Fujioka et al. | 345/92 |
| 2006/0274014 | A1 * | 12/2006 | Fujikura | 345/98 |
| 2008/0174462 | A1 * | 7/2008 | Tsuchi | 341/144 |
| 2009/0167667 | A1 * | 7/2009 | Suzuki | 345/96 |
| 2009/0201237 | A1 * | 8/2009 | Nishimura | 345/87 |

FOREIGN PATENT DOCUMENTS

| | | | |
|---|---|---|---|
| JP | 10-062744 | A | 3/1998 |
| JP | 2006-292807 | A | 10/2006 |

* cited by examiner

*Primary Examiner* — Hong Zhou
(74) *Attorney, Agent, or Firm* — Kubotera & Associates, LLC

(57) ABSTRACT

A drive circuit for driving a display panel includes a first operation amplifier for operating using a first power source voltage and a second power source voltage; a second operation amplifier for operating using a third power source voltage and a fourth power source voltage; a control unit for supplying a first control voltage and a second control voltage; and a switch circuit for switching the first operation amplifier and the second operation amplifier. The switch circuit includes an n-channel type field effect transistor. The control unit applies the first control voltage to the n-channel type field effect transistor, so that the n-channel type field effect transistor transits from a non-conductive state to a conductive state.

19 Claims, 10 Drawing Sheets

VDD
Vp1 VMM
VSS

VDD
Vn2 VMM
VSS

VDD
Vp3 VMM
VSS

VDD
Vn4 VMM
VSS

VDD
VB VMM
VSS

VDD
VA VMM
VSS t1
t2

Vp1
VDD
VMM
VSS

Vn1
VDD
VMM
VSS

Vp2
VDD
VMM
VSS

Vn2
VDD
VMM
VSS

Vp3
VDD
VMM
VSS

Vn3
VDD
VMM
VSS

Vp4
VDD
VMM
VSS

Vn4
VDD
VMM
VSS

VB
VDD
VMM
VSS

VB
VDD
VMM
VSS t1
t2
t3
t4

Vp1
VDD
VMM
VSS
Vpt

Vn1

Vp2

Vn2
Vnt

Vp3

Vn3

Vp4

Vn4

VB t1
t2
t3
t4

Vp1
VDD
VMM
VSS

Vn1
VDD
VMM
VSS

Vp2
VDD
VMM
VSS

Vn2
VDD
VMM
VSS

Vp3
VDD
VMM
VSS

Vn3
VDD
VMM
VSS

Vp4
VDD
VMM
VSS

Vn4
VDD
VMM
VSS

VB
VDD
VMM
VSS

VB
VDD
VMM
VSS t1
T1
t2
t3
T2
t4

DRIVE CIRCUIT AND DISPLAY DEVICE

BACKGROUND OF THE INVENTION AND RELATED ART STATEMENT

The present invention relates to a drive circuit for driving a display panel such as a liquid crystal display panel, and a display device including the display panel.

In a conventional liquid crystal display device of an active matrix type, a liquid crystal display panel generally has a plurality of display pixels arranged in a matrix pattern. Each of the display pixels includes a liquid crystal layer sandwiched between two glass plates and an active element such as TFT (Thin Film Transistor) for controlling a voltage applied to the liquid crystal layer.

Further, the conventional liquid crystal display device includes a drive circuit for driving the liquid crystal display panel. The drive circuit includes a gate driver and a source driver. The gate driver is provided for supplying a control signal through a scanning line (a gate line) for tuning on or off each of the active elements. The source driver is provided for supplying a gradation voltage through a data line (a source line) to opposite electrodes sandwiching the liquid crystal layer of each of the display pixels.

When an electrical field is applied to the liquid crystal layers with a direct current with the same polarity for a prolonged period of time, the liquid crystal layers tend to deteriorate. In order to prevent the deterioration, a specific drive method has been widely adopted. In the drive method, the graduation voltage with a positive polarity and the graduation voltage with a negative polarity are alternately supplied to each of the display pixels. The graduation voltage with the positive polarity is greater than a reference voltage, and the graduation voltage with the negative polarity is smaller than the reference voltage.

For example, when a dot inversion method is adopted as the drive method, the graduation voltage with the positive polarity and the graduation voltage with the negative polarity are alternately supplied per dot (for example, per display pixel). When a line inversion method is adopted as the drive method, the graduation voltage with the positive polarity and the graduation voltage with the negative polarity are alternately supplied per line.

When the liquid crystal display device adopts the drive method described above, the source driver generally includes an impedance conversion circuit. The impedance conversion circuit includes an operation amplifier (referred to as a high voltage side operation amplifier) for outputting an analog voltage with the positive polarity and an operation amplifier (referred to as a low voltage side operation amplifier) for outputting an analog voltage with the negative polarity.

Patent Reference 1 has disclosed a conventional liquid crystal display device of an active matrix type. According to Patent Reference 1, a source driver includes a high voltage side operation amplifier (or a positive amplifier) of a voltage follower type and a low voltage side operation amplifier (or a negative amplifier) of the voltage follower type.

In the source driver disclosed in Patent Reference 1, the high voltage side operation amplifier is operated with a group of a power source voltage AVDD and a power source voltage AGNDP (AVDD>AGNDP), and the low voltage side operation amplifier is operated with a group of a power source voltage AVDDN and a power source voltage AGND (AVDDN>AGND). Accordingly, four power source voltages AVDD, AGNDP, AVDDN, and AGND are used for driving the high voltage side operation amplifier and the low voltage side operation amplifier.

Patent Reference 1: Japanese Patent Publication No. 2006-292807

Patent Reference 2 has disclosed another conventional liquid crystal display device. According to Patent Reference 2, a source driver includes a high voltage side operation amplifier operated with a group of a power source voltage VLCD and a power source voltage VMM (VMM=1/2 VLCD) and a low voltage side operation amplifier operated with a group of the power source voltage VMM and a ground GND (GND=0 V). Accordingly, three power source voltages VCLD, AMM, and GND are used for driving the high voltage side operation amplifier and the low voltage side operation amplifier.

Patent Reference 2: Japanese Patent Publication No. 10-062744

According to Patent Reference 1 and Patent Reference 2, the source driver further includes a switch circuit for connecting each of the data lines alternately to an output terminal of the high voltage side operation amplifier and an output terminal of the low voltage side operation amplifier. Accordingly, the analog voltage with the positive polarity and the analog voltage with the negative polarity are alternately supplied to the data lines.

More specifically, the switch circuit is configured to connect the data line at an i-th position to the high voltage side operation amplifier and the data line at an (i+1)-th position adjacent to the i-th position to the low voltage side operation amplifier. Accordingly, the analog voltage with the positive polarity is supplied to the data line at the i-th position, and the analog voltage with the negative polarity is supplied to the data line at the (i+1)-th position. At this moment, a potential of the data line at the i-th position is lower than a reference voltage, and a potential of the data line at the (i+1)-th position is higher than the reference voltage.

At the next timing, the switch circuit switches the data line at the i-th position from the high voltage side operation amplifier to the low voltage side operation amplifier, and the data line at the (i+1)-th position from the low voltage side operation amplifier to the high voltage side operation amplifier. As a result, the analog voltage with the negative polarity is supplied to the data line at the i-th position, and the analog voltage with the positive polarity is supplied to the data line at the (i+1)-th position. Accordingly, the potential of the data line at the i-th position transits from a high potential to a low potential, and the potential of the data line at the (i+1)-th position transits from a low potential to a high potential.

In the conventional liquid crystal display device, when the switch circuit switches the data line, the output terminal of the high voltage side operation amplifier is switched from the data line at the i-th to the data line at the (i+1)-th, and the output terminal of the low voltage side operation amplifier is switched from the data line at the (i+1)-th to the data line at the i-th. Accordingly, a potential of the output terminal of the high voltage side operation amplifier may abruptly decrease, and a potential of the output terminal of the low voltage side operation amplifier may abruptly increase temporarily.

When the potential of the output terminal of the high voltage side operation amplifier abruptly decreases, or the potential of the output terminal of the low voltage side operation amplifier abruptly increases, a bias in a forward direction is applied to a parasite bipolar transistor inside the high voltage side operation amplifier or a parasite bipolar transistor inside the low voltage side operation amplifier. As a result, an excess current may flow in the parasite bipolar transistor, thereby damaging the high voltage side operation amplifier or the low voltage side operation amplifier.

In view of the problems described above, an object of the present invention is to provide a drive circuit for driving a display panel, and a display device including the display panel capable of solving the problems of the conventional display device. In the present invention, it is possible to prevent an excess current from flowing in a high voltage side operation amplifier and a low voltage side operation amplifier.

Further objects and advantages of the invention will be apparent from the following description of the invention.

SUMMARY OF THE INVENTION

In order to attain the objects described above, according to a first aspect of the present invention, a drive circuit is to drive a display panel having a plurality of signal lines arranged in parallel to each other; a plurality of data lines arranged to cross the signal lines; and capacitance loads disposed in areas near cross points of the signal lines and the data lines.

According to the first aspect of the present invention, the drive circuit includes a first operation amplifier for operating using a first power source voltage and a second power source voltage greater than the first power source voltage to generate an analog voltage with a negative polarity to be supplied to the capacitance loads; a second operation amplifier for operating using a third power source voltage and a fourth power source voltage greater than the third power source voltage to generate an analog voltage with a positive polarity to be supplied to the capacitance loads; a control unit for supplying a first control voltage and a second control voltage; and a switch circuit for switching the first operation amplifier from a first data line to a second data line according to the first control voltage, and for switching the second operation amplifier from the second data line to the first data line according to the second control voltage.

According to the first aspect of the present invention, the switch circuit includes an n-channel type field effect transistor for connecting an output terminal of the first operation amplifier to the second data line. The control unit applies the first control voltage within a first voltage range smaller than a level greater than the second power source voltage by a threshold voltage of the n-channel type field effect transistor and greater than the first power source voltage to a gate of the n-channel type field effect transistor, so that the n-channel type field effect transistor transits from a non-conductive state to a conductive state.

According to a second aspect of the present invention, a drive circuit is to drive a display panel having a plurality of signal lines arranged in parallel to each other; a plurality of data lines arranged to cross the signal lines; and capacitance loads disposed in areas near cross points of the signal lines and the data lines.

According to the second aspect of the present invention, the drive circuit includes a first operation amplifier for operating using a first power source voltage and a second power source voltage greater than the first power source voltage to generate an analog voltage with a negative polarity to be supplied to the capacitance loads; a second operation amplifier for operating using a third power source voltage and a fourth power source voltage greater than the third power source voltage to generate an analog voltage with a positive polarity to be supplied to the capacitance loads; a control unit for supplying a first control voltage and a second control voltage; and a switch circuit for switching the first operation amplifier from a first data line to a second data line according to the first control voltage, and for switching the second operation amplifier from the second data line to the first data line according to the second control voltage.

According to the second aspect of the present invention, the switch circuit includes a p-channel type field effect transistor for connecting an output terminal of the second operation amplifier to the first data line. The control unit applies the second control voltage within a second voltage range greater than a level smaller than the third power source voltage by a threshold voltage of the p-channel type field effect transistor, and smaller than the fourth power source voltage to a gate of the p-channel type field effect transistor, so that the p-channel type field effect transistor transits from a non-conductive state to a conductive state.

According to a third aspect of the present invention, a display device includes one of the drive circuit in the first aspect and the drive circuit in the second aspect.

In the present invention, when the first operation amplifier is switched from the first data line to the second data line, and the second operation amplifier is switched from the second data line to the first data line, it is possible to securely prevent an excessive current from flowing through the first operation amplifier and the second operation amplifier.

DETAILED DESCRIPTION OF PREFERRED EMBODIMENTS

Hereunder, preferred embodiments of the present invention will be explained with reference to the accompanying drawings.

First Embodiment

Figure 1:
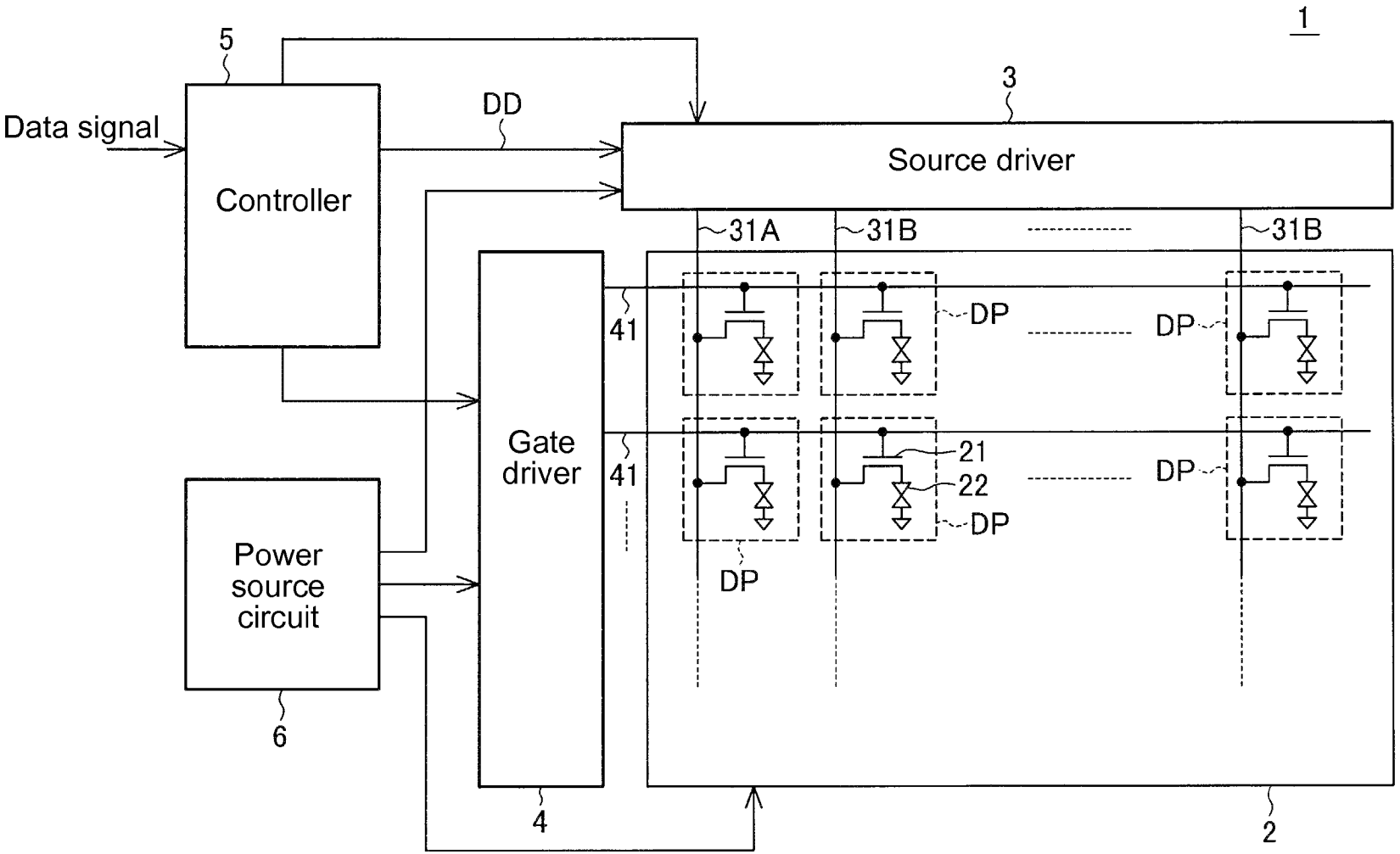
FIG. 1 is a block diagram showing a configuration of a liquid crystal display device according to a first embodiment of the present invention.

A first embodiment of the present invention will be explained. FIG. 1 is a block diagram showing a configuration of a liquid crystal display device 1 according to the first embodiment of the present invention.

As shown in FIG. 1, the liquid crystal display device 1 includes a liquid crystal display panel 2; a source driver 3; a gate driver 4; a controller 5; and a power source circuit 6. The controller 5 or a control unit is provided for controlling operations of the source driver 3 and the gate driver 4.

In the embodiment, the liquid crystal display panel 2 includes a back light unit (not shown); scanning lines 41 (source lines) arranged in parallel to each other; and data lines 31A and 31B (source lines) arranged to be away from and cross the scanning lines 41.

As shown in FIG. 1, the data lines 31A are situated at even-number positions, and the data lines 31B are situated at odd-number positions. Display pixels DP are disposed at cross sections of the scanning lines 41 and the data lines 31A and 31B.

As shown in FIG. 1, the display pixels DP are arranged in a two-dimensional pattern. Each of the display pixels DP includes a liquid crystal display element 22 (a capacitance load) having a liquid crystal layer sandwiched with opposing electrodes (not shown); and an active element 21 such as TFT (Thin Film Transistor) for controlling an electrical field applied to the liquid crystal display element 22. The active element 21 has one controlled terminal connected to one of the opposing electrodes, and the power source circuit 6 supplies a common voltage to the other of the opposing electrodes. The active element 21 has another controlled terminal connected to the data line 31A or the data line 31B. Further, the active element 21 has a control terminal (a gate) connected to one of the scanning lines 41.

In the embodiment, the controller 5 is provided for applying an image processing to a data signal supplied from an external signal source (not shown) to generate digital data DD, so that the controller 5 outputs the digital data DD to the source driver 3 per horizontal display line. The gate driver 4 is provided for sequentially outputting a pulse voltage to the scanning lines 41, so that the active elements 21 are turned on.

In the embodiment, the source driver 3 is provided for converting the digital data DD to an analog gradation voltage (referred to as a gradation voltage), and for converting impedance of the gradation voltage. Further, the source driver 3 outputs the gradation voltage to the data lines 31A and 31B in parallel, so that the gradation voltage is applied to one of the opposing electrodes of each of the liquid crystal display elements 22 through each of the active elements 21 in the on-state.

In the embodiment, when the gradation voltage is applied to each of the display pixels DP, each of the active elements 21 is turned off, so that each of the display pixels DP holds the gradation voltage. Accordingly, an electrical field is created between the opposing electrodes of each of the liquid crystal display elements 22 according to a voltage difference between the gradation voltage and the common voltage. In each of the liquid crystal display elements 22, liquid crystal molecules are oriented according to the electrical field thus generated, thereby forming an optical transmittance according to an orientation of the liquid crystal molecules.

Figure 2:
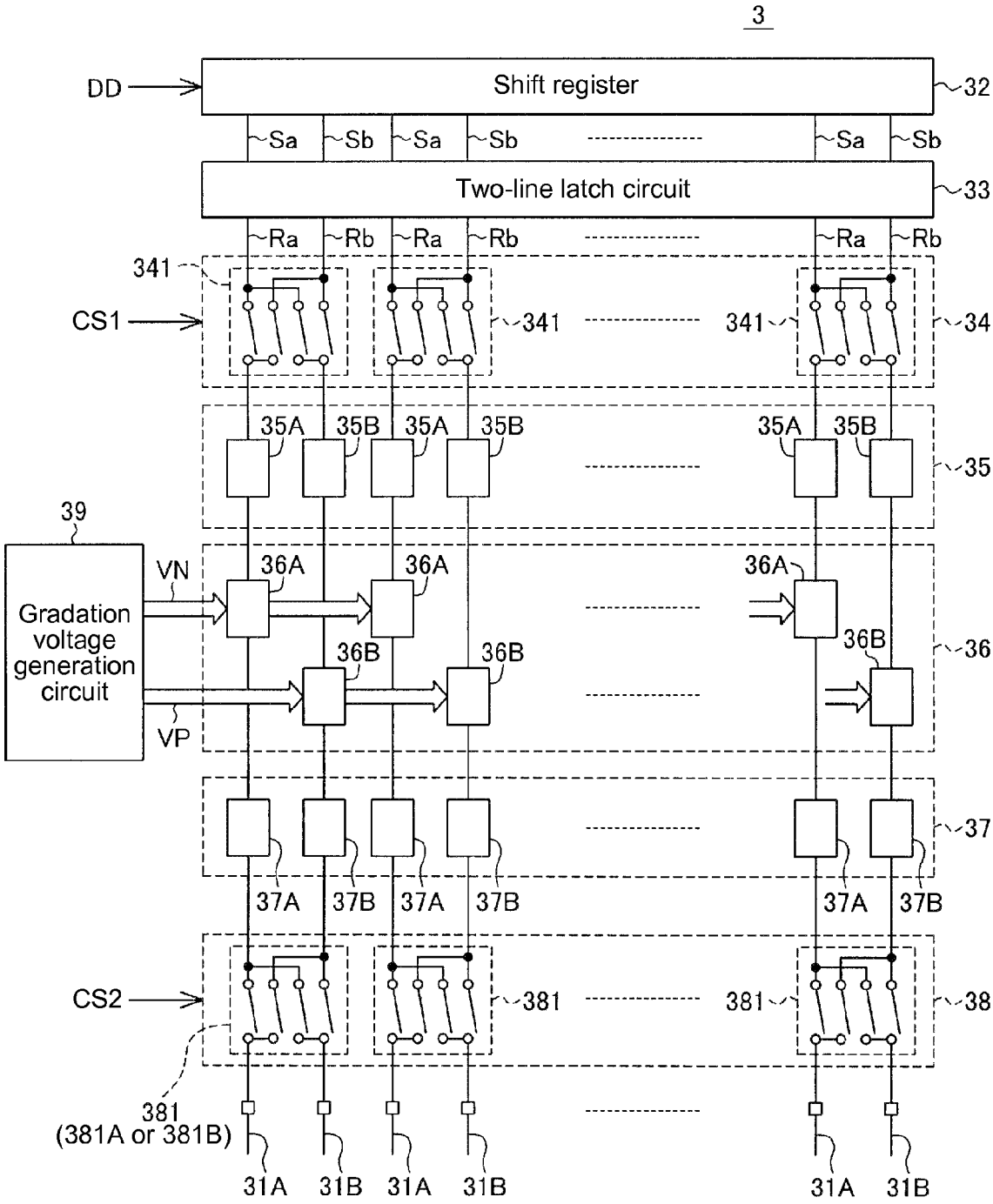
FIG. 2 is a block diagram showing a configuration of a source driver of the liquid crystal display device according to the first embodiment of the present invention.

FIG. 2 is a block diagram showing a configuration of the source driver 3 of the liquid crystal display device 1 according to the first embodiment of the present invention.

As shown in FIG. 2, the source driver 3 includes a shift register 32; a two-line latch circuit 33; a line switching circuit 34; a level shift circuit 35; a voltage conversion circuit 36; an impedance conversion circuit 37; a line switching circuit 38; and a gradation voltage generation circuit 39. The impedance conversion circuit 37 includes a plurality of pairs of a low voltage side operation amplifier 37A of a voltage follower type and a high voltage side operation amplifier 37B of a voltage follower type.

Figure 3:
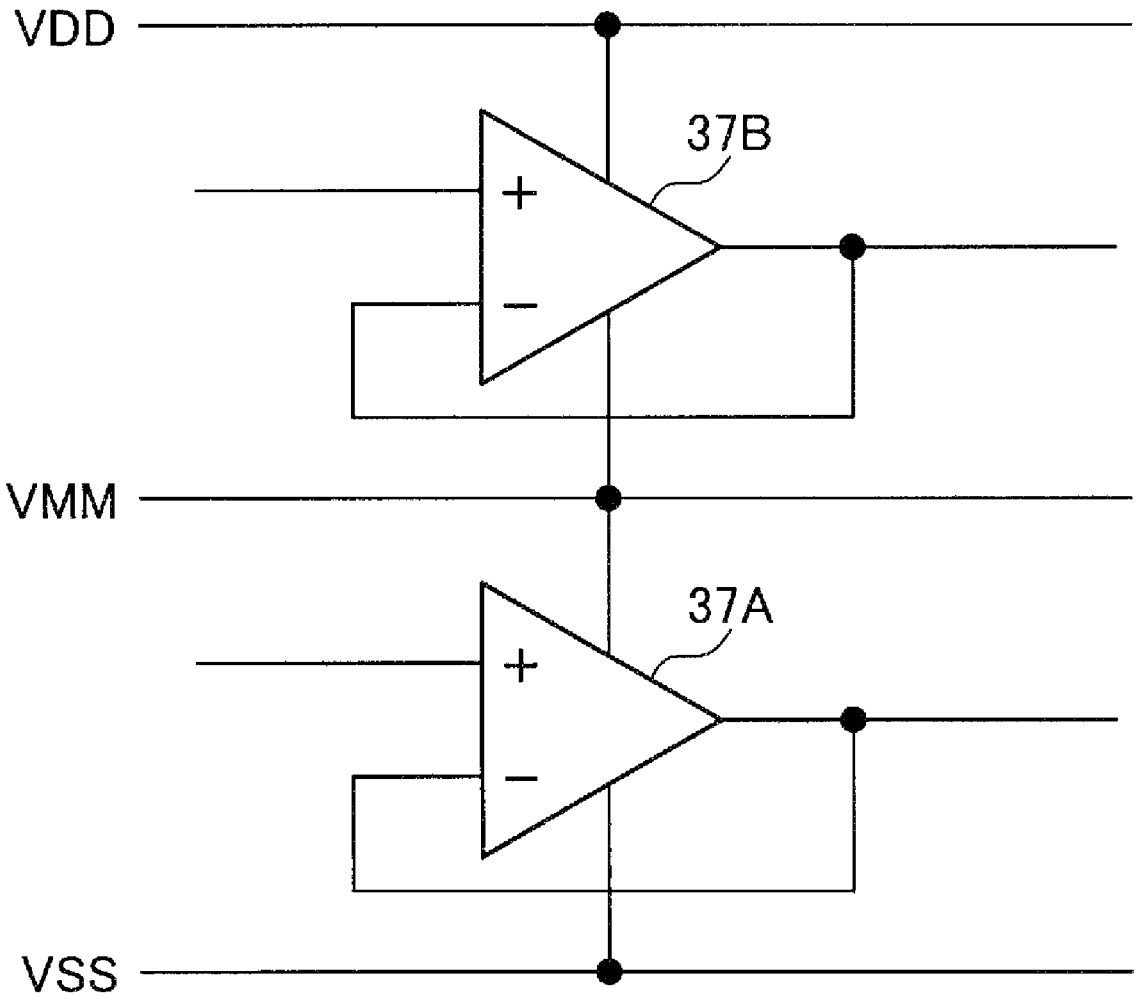
FIG. 3 is a circuit diagram showing a low voltage side operation amplifier and a high voltage side operation amplifier of the source driver of the liquid crystal display device according to the first embodiment of the present invention.

FIG. 3 is a circuit diagram showing the low voltage side operation amplifier 37A and the high voltage side operation amplifier 37B of the source driver 3 of the liquid crystal display device 1 according to the first embodiment of the present invention.

As shown in FIG. 3, the low voltage side operation amplifier 37A is a non-inversion amplifier for operating using a power source voltage VSS and a common power source voltage VMM greater than the power source voltage VSS, and the high voltage side operation amplifier 37B is a non-inversion amplifier for operating using the common power source voltage VMM and a power source voltage VDD greater than the common power source voltage VMM.

In the embodiment, the shift register 32 is provided for retrieving the digital data DD (multi gradation data) transmitted from the controller 5, and for outputting the digital data DD per one horizontal line to the two-line latch circuit 33 in parallel through distribution lines Sa and Sb corresponding respectively to the data lines 31A and 31B. The distribution line Sa corresponds to the data line 31A at the even-number position, and the distribution line Sa corresponds to the data line 31B at the odd-number position.

In the embodiment, the two-line latch circuit 33 is provided for latching a parallel output of the shift register 32, and for outputting held data to the line switching circuit 34 in parallel through distribution lines Ra and Rb corresponding respectively to the distribution lines Sa and Sb.

In the embodiment, the line switching circuit 34 includes switch circuits 341 each disposed per one pair of the distribution lines Ra and Rb. Each of the switch circuits 341 operates according to a control signal CS1 transmitted from the controller 5. The level shift circuit 35 is arranged at a later stage with respect to the line switching circuit 34, and includes pairs of a level shifter 35A and a level shifter 35B. The level shifter 35A is provided for the gradation voltage with the negative polarity, and the level shifter 35A is provided for the gradation voltage with the positive polarity.

In the embodiment, each of the switch circuits 341 connects the distribution line Ra in the pair of the distribution lines Ra and Rb to the level shifter 35A, and connects the distribution line Rb in the pair of the distribution lines Ra and Rb to the level shifter 35B at a specific timing. Accordingly, a signal transmitting through the distribution line Ra is supplied to the level shifter 35A, and a signal transmitting through the distribution line Rb is supplied to the level shifter 35B. In the following description, a connection state of the switch circuits 341 in this situation is referred to as a straight connection.

Further, at another specific timing, each of the switch circuits 341 connects the distribution line Ra to the level shifter 35B, and connects the distribution line Rb to the level shifter 35A. Accordingly, the signal transmitting through the distribution line Ra is supplied to the level shifter 35B, and the signal transmitting through the distribution line Rb is supplied to the level shifter 35A. In the following description, a connection state of the switch circuits 341 in this situation is referred to as a cross connection.

In the embodiment, the gradation voltage generation circuit 39 is provided for generating, from the voltage supplied from the power source circuit 6, a gradation voltage group VP with the positive polarity having $2^N$ (N is a positive integer) levels and greater than a reference voltage (for example, a GND level) and a gradation voltage group VN with the negative polarity having $2^N$ levels and smaller than the reference voltage. For example, an object is displayer with an 8 bit gradation, the gradation voltage generation circuit 39 generates the gradation voltage with the positive polarity having the $2^8$ (=256) levels, and the gradation voltage with the negative polarity having the $2^8$ (=256) levels.

In the embodiment, the voltage conversion circuit 36 includes pairs of a gradation voltage selection unit 36A and a gradation voltage selection unit 36B. The gradation voltage selection unit 36A is provided for selecting a gradation voltage corresponding to an output of the level shifter 35A from the gradation voltage group VN with the negative polarity, so that the gradation voltage selection unit 36A inputs the gradation voltage to the low voltage side operation amplifier 37A. The gradation voltage selection unit 36B is provided for selecting a gradation voltage corresponding to an output of the level shifter 36B from the gradation voltage group VP with the positive polarity, so that the gradation voltage selection unit 36B inputs the gradation voltage to the high voltage side operation amplifier 37B.

In the embodiment, the line switching circuit 38 includes switch circuits 381 disposed per pair of the low voltage side operation amplifier 37A and the high voltage side operation amplifier 37B. Each of the switch circuits 381 operates according to a control signal CS2 transmitted from the controller 5. When the switch circuits 341 are in the straight connection, each of the switch circuits 381 connects an output terminal of the low voltage side operation amplifier 37A to one end portion of the data line 31A, and connects an output terminal of the high voltage side operation amplifier 37B to one end portion of the data line 31B. In this connection state, it is referred to as that the switch circuits 381 are in the straight connection. Accordingly, the gradation voltage with the negative polarity is supplied to the data line 31A at the even-number position, and the gradation voltage with the positive polarity is supplied to the data line 31B at the odd-number position.

Further, when the switch circuits 341 are in the cross connection, each of the switch circuits 381 connects the output terminal of the low voltage side operation amplifier 37A to the end portion of the data line 31B, and connects the output terminal of the high voltage side operation amplifier 37B to the end portion of the data line 31A. In this connection state, it is referred to as that the switch circuits 381 are in the cross connection. Accordingly, the gradation voltage with the positive polarity is supplied to the data line 31A at the even-number position, and the gradation voltage with the negative polarity is supplied to the data line 31B at the odd-number position.

Figure 4A:
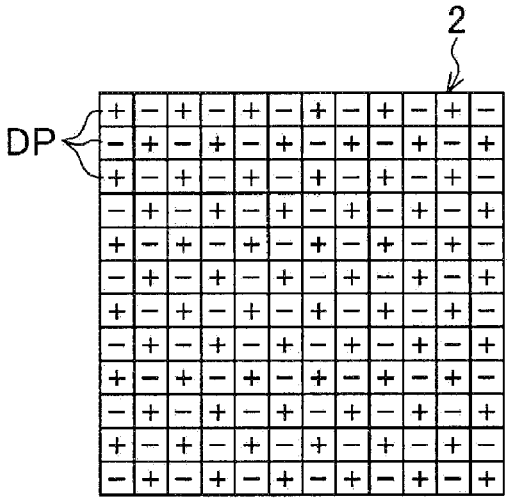
FIGS. 4(A) and 4(B) are schematic views showing a drive operation of the source driver of the liquid crystal display device with a dot inversion method according to the first embodiment of the present invention.
Figure 4B:
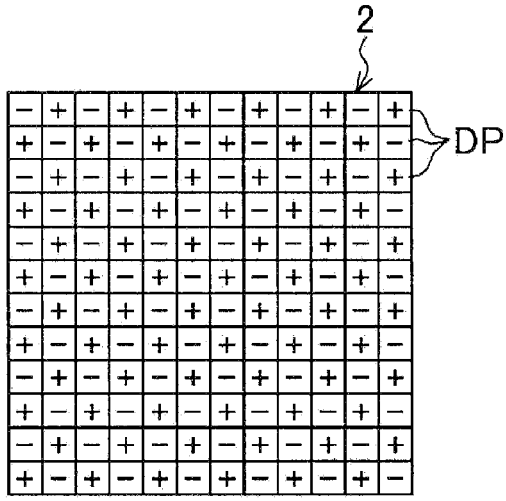
Figure 5A:
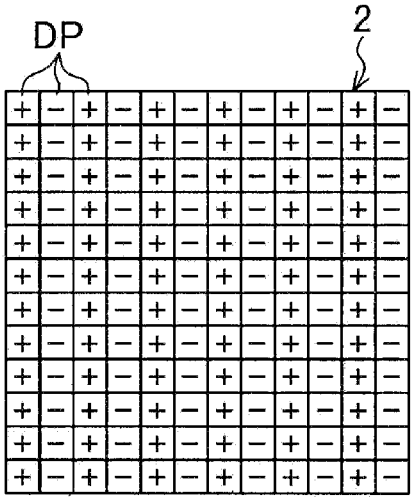
FIGS. 5(A) and 5(B) are schematic views showing a drive operation of the source driver of the liquid crystal display device with a line inversion method according to the first embodiment of the present invention.
Figure 5B:
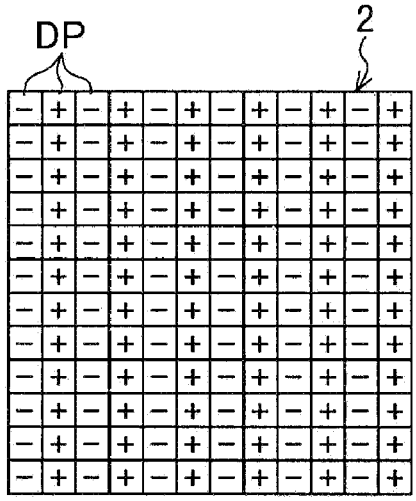

In the embodiment, with the combination of the line switching circuit 34 and the line switching circuit 38, it is possible to drive the liquid crystal display panel 2 with the dot inversion method and the line inversion method. FIGS. 4(A) and 4(B) are schematic views showing a drive operation of the source driver 3 of the liquid crystal display device 1 with the dot inversion method according to the first embodiment of the present invention. FIGS. 5(A) and 5(B) are schematic views showing a drive operation of the source driver 3 of the liquid crystal display device 1 with the line inversion method according to the first embodiment of the present invention.

As shown in FIGS. 4(A) and 4(B) and FIGS. 5(A) and 5(B), when one of the display pixels DP holds the gradation voltage with the positive polarity, the one of the display pixels DP is represented with a symbol "+". When one of the display pixels DP holds the gradation voltage with the negative polarity, the one of the display pixels DP is represented with a symbol "−".

As shown in FIGS. 4(A) and 4(B), two of the display pixels DP arranged adjacently in a vertical display direction hold the gradation voltages with opposite polarities, and two of the display pixels DP arranged adjacently in a horizontal display direction hold the gradation voltages with opposite polarities as well. It is configured such that the state shown in FIG. 4(A) and the state shown in FIG. 4(B) are switched per, for example, frame or field.

On the other hand, as shown in FIGS. 5(A) and 5(B), two lines of the display pixels DP arranged adjacently in a horizontal display direction hold the gradation voltages with opposite polarities. It is configured such that the state shown in FIG. 5(A) and the state shown in FIG. 5(B) are switched per, for example, frame or field.

Figure 6:
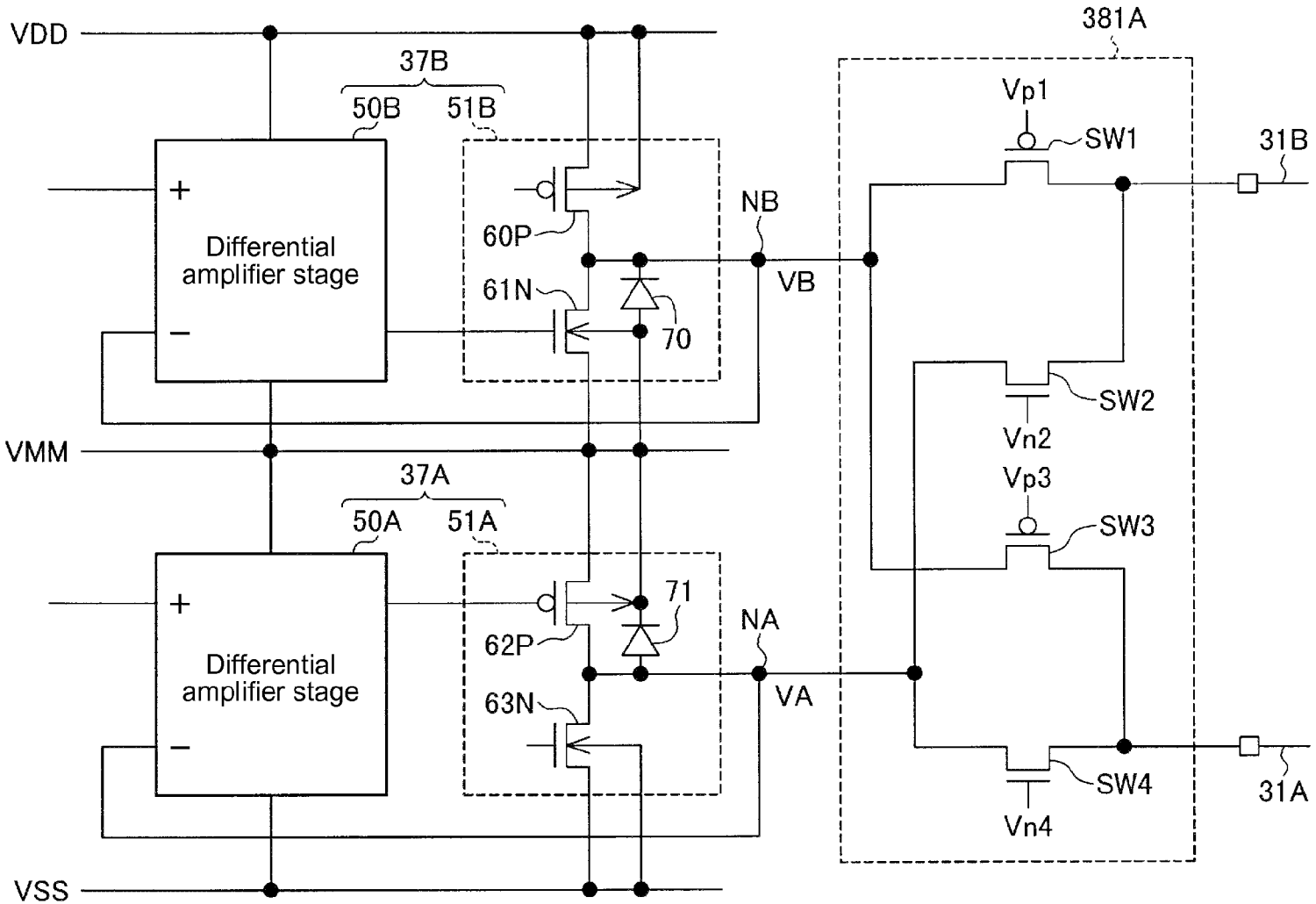
FIG. 6 is a circuit diagram showing a switch circuit of the source driver of the liquid crystal display device according to the first embodiment of the present invention.

FIG. 6 is a circuit diagram showing the switch circuit 381 of the source driver 3 of the liquid crystal display device 1 according to the first embodiment of the present invention. More specifically, the circuit diagram shown in FIG. 6 shows configurations of the low voltage side operation amplifier 37A and the high voltage side operation amplifier 37B of the source driver 3, and a configuration of the switch circuit 381 (381A) corresponding to the low voltage side operation amplifier 37A and the high voltage side operation amplifier 37B.

As shown in FIG. 6, the low voltage side operation amplifier 37A is formed of a differential amplifier stage 50A and an output amplifier stage 51A, and the high voltage side operation amplifier 37B is formed of a differential amplifier stage 50B and an output amplifier stage 51B. An output terminal NA (a node) of the low voltage side operation amplifier 37A is connected to a reverse input terminal (−) of the differential amplifier stage 50A, and an output terminal NB (a node) of the high voltage side operation amplifier 37B is connected to a reverse input terminal (−) of the differential amplifier stage 50B. It is noted that the differential amplifier stage 50A and the differential amplifier stage 50B may have a well-known configuration.

In the embodiment, the output amplifier stage 51B of the high voltage side operation amplifier 37B includes a PMOS transistor 60P (a p-channel type field effect transistor) and an NMOS transistor 61N (an n-channel type field effect transistor). The PMOS transistor 60P has a gate connected to a power source line of the power source voltage VDD, and a drain connected to a drain of the NMOS transistor 61N. A constant voltage is applied to a gate of the PMOS transistor 60P. A back gate of the PMOS transistor 60P is connected to the power source line of the power source voltage VDD. Accordingly, the PMOS transistor 60P operates as a constant current source. In the NMOS transistor 61N, a gate is connected to an output terminal of the differential amplifier stage 50B, and a source is connected to the power source line of the power source voltage VDD.

In the embodiment, the output amplifier stage 51A of the low voltage side operation amplifier 37A includes a PMOS transistor 62P (a p-channel type field effect transistor) and an NMOS transistor 63N (an n-channel type field effect transistor). The NMOS transistor 63N has a source connected to the power source line of the power source voltage VDD, and a drain connected to the drain of the PMOS transistor 62P. A constant voltage is applied to a gate of the NMOS transistor 63N. A back gate of the NMOS transistor 63N is connected to a power source line of the power source voltage VSS. Accordingly, the NMOS transistor 63N operates as a constant current source. In the PMOS transistor 62P, a gate is connected to an output terminal of the differential amplifier stage 50A, and a source is connected to the power source line of the power source voltage VMM.

In the embodiment, the switch circuit 381A includes an MOS switch SW1 formed of a PMOS transistor, an MOS switch SW2 formed of an NMOS transistor, an MOS switch SW3 formed of a PMOS transistor, and an MOS switch SW4 formed of an NMOS transistor. The MOS switch SW1 is tuned on (an on state or a conductive state) or off (an off state or a non-conductive state) according to a level of a gate voltage Vp1. When the MOS switch SW1 is turned on (the on state), the MOS switch SW1 connects the output terminal NB of the high voltage side operation amplifier 37B to the data line 31B. The MOS switch SW2 is tuned on (an on state or a conductive state) or off (an off state or a non-conductive state) according to a level of a gate voltage Vn2. When the MOS switch SW2 is turned on (the on state), the MOS switch SW2 connects the output terminal NA of the low voltage side operation amplifier 37A to the data line 31B.

Further, the MOS switch SW3 is tuned on (an on state or a conductive state) or off (an off state or a non-conductive state) according to a level of a gate voltage Vp3. When the MOS switch SW3 is turned on (the on state), the MOS switch SW3 connects the output terminal NB of the high voltage side operation amplifier 37B to the data line 31A. The MOS switch SW4 is tuned on (an on state or a conductive state) or off (an off state or a non-conductive state) according to a level of a gate voltage Vn4. When the MOS switch SW4 is turned on (the on state), the MOS switch SW4 connects the output terminal NA of the low voltage side operation amplifier 37A to the data line 31A.

When the switch circuit 381A is switched from the straight connection to the cross connection through a conventional control method, an excess current may flow through the low voltage side operation amplifier 37A and the high voltage side operation amplifier 37B. This phenomenon will be explained next.

When the power source voltage VSS is applied to gates of the MOS switch SW1 and the MOS switch SW2, and the power source voltage VDD is applied to gates of the MOS switch SW3 and the MOS switch SW4, the MOS switch SW1 and the MOS switch SW4 are turned on, and the MOS switch SW2 and the MOS switch SW3 are turned off. In the state, the switch circuit 381A becomes the straight connection.

At this moment, the output terminal NB of the high voltage side operation amplifier 37B is connected to the data line 31B, and the output terminal NA of the low voltage side operation amplifier 37A is connected to the data line 31A. Accordingly, immediately after the gradation voltage at the low level and the gradation voltage at the high level are output to the data lines 31A and 31B, respectively, the potential of the data line 31A becomes low and the potential of the data line 31B becomes high.

Afterward, when the power source voltage VDD is applied to gates of the MOS switch SW1 and the MOS switch SW2, and the power source voltage VSS is applied to gates of the MOS switch SW3 and the MOS switch SW4, the MOS switch SW1 and the MOS switch SW4 are switched from the on state to the off state, and the MOS switch SW2 and the MOS switch SW3 are switched from the off state to the on state. In the state, the switch circuit 381A becomes the cross connection.

Accordingly, the data line 31B with the high potential is connected to the output terminal NA of the low voltage side operation amplifier 37A, and the data line 31A with the low potential is connected to the output terminal NB of the high voltage side operation amplifier 37B. As a result, the potential of the output terminal NA increases and the potential of the output terminal NB decreases. Accordingly, the potential of the output terminal NA may become higher than the common power source voltage VMM, and the potential of the output terminal NB may become lower than the common power source voltage VMM.

In this case, when a large bias in a forward direction is applied to a parasite diode 71 of the PMOS transistor 62P of the low voltage side operation amplifier 37A, a parasite bipolar transistor of an npn type of the PMOS transistor 62P is turned on. Similarly, when a large bias in a forward direction is applied to a parasite diode 70 of the NMOS transistor 61N of the high voltage side operation amplifier 37B, a parasite bipolar transistor of a pnp type of the NMOS transistor 61N is turned on. Accordingly, an excess current may flow through the parasite bipolar transistors, thereby causing the phenomenon called a bipolar action. When such an excess current flows through the parasite bipolar transistors, elements of the low voltage side operation amplifier 37A and the high voltage side operation amplifier 37B may be damaged. It is noted that not only in the output amplifier stage 51A and 51*b*, but the bipolar action may occur in the parasite bipolar transistors in the output amplifier stage 51A and 51*b*.

In order to prevent the bipolar action, in the embodiment, when the switch circuit 381A is switched between the straight connection and the cross connection, the controller 5 controls gate voltages Vn2 and Vn4 of the MOS switch SW2 and the MOS switch SW4, that are the n-channel type field effect transistors, within a voltage range Δn.

Further, the controller 5 controls gate voltages Vp1 and Vp3 of the MOS switch SW1 and the MOS switch SW3, that are the p-channel type field effect transistors, within a voltage range Δp.

In the embodiment, the voltage range Δn is expressed with the following equation (1), and the voltage range Δp is expressed with the following equation (2):

$$VSS < Vng \leqq VMM1 + Vnt \quad (1)$$

$$VMM2 - Vpt \geqq Vpg < VDD \quad (2)$$

where Vng is a gate voltage of the n-channel type field effect transistor as a subject of the control operation; Vnt is a threshold voltage of the n-channel type field effect transistor; and VMM1 is a power source voltage used in the low voltage side operation amplifier 37A connected to the re-channel type field effect transistor (VMM1=VMM in the embodiment). Further, Vpt is a threshold voltage of the p-channel type field effect transistor; and VMM2 is a power source voltage used in the high voltage side operation amplifier 37B connected to the p-channel type field effect transistor (VMM2=VMM in the embodiment).

Figures 7A, 7B, 7C, 7D, 7E, 7F:
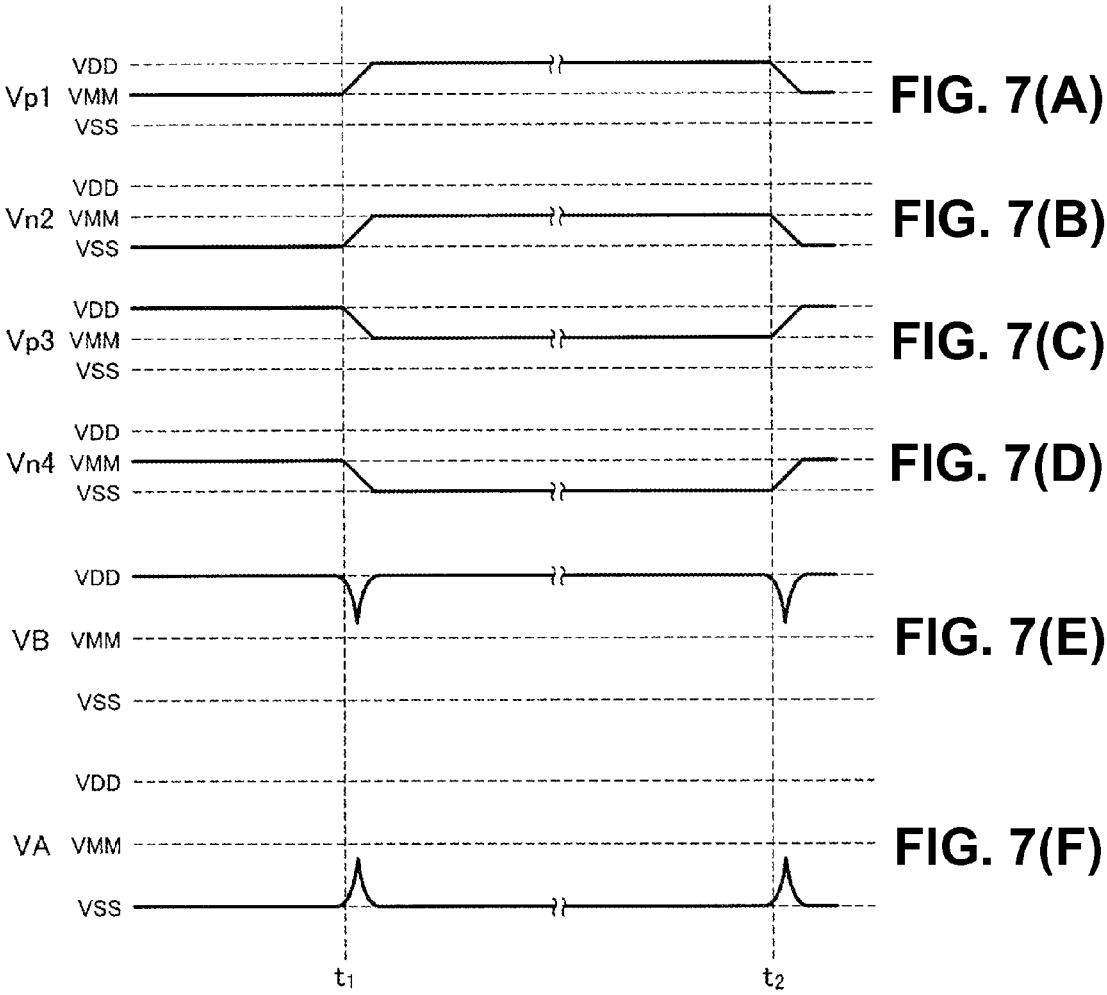
FIGS. 7(A) to 7(F) are timing charts showing a control operation of the source driver of the liquid crystal display device when the switch circuit is switched between a straight connection and a cross connection according to the first embodiment of the present invention.

A control operation of the source driver 3 will be explained next. FIGS. 7(A) to 7(F) are timing charts showing the control operation of the source driver 3 of the liquid crystal display device 1 when the switch circuit 381A is switched between the straight connection and the cross connection according to the first embodiment of the present invention. More specifically, FIGS. 7(A) to 7(D) are graphs showing wave shapes of the gate voltages Vp1, Vn2, Vp3, and Vn4 of the MOS switches SW1, SW2, SW3, and SW4, respectively. Further, FIG. 7(E) is a graph showing a potential VB of the output terminal NB of the high voltage side operation amplifier 37B, and FIG. 7(F) is a graph showing a potential VA of the output terminal NA of the low voltage side operation amplifier 37A.

As shown in FIGS. 7(A) to 7(D), the switch circuit 381A is in the straight connection before a timing t1. More specifically, before the timing t1, the controller 5 sets the gate voltage Vp1 of the MOS switch SW1 to the common power source voltage VMM, and sets the gate voltage Vn4 of the MOS switch SW4 to the common power source voltage VMM, so that the MOS switch SW1 and the MOS switch SW4 are turned on (the on state). Further, the controller 5 sets the gate voltage Vn2 of the MOS switch SW2 to the power source voltage VSS with the low level, and sets the gate voltage Vp3 of the MOS switch SW3 to the power source voltage VDD with the high level, so that the MOS switch SW2 and the MOS switch SW3 are turned off (the off state).

As shown in FIGS. 7(A) and 7(D), at the timing t1, the controller 5 switches the gate voltage Vp1 of the MOS switch SW1 from the common power source voltage VMM to the power source voltage VDD with the high level, and switches the gate voltage Vn4 of the MOS switch SW4 from the common power source voltage VMM to the power source voltage VSS with the low level, so that the MOS switch SW1 and the MOS switch SW4 are transited from the on state to the off state.

At the same time, as shown in FIGS. 7(B) and 7(C), at the timing t1, the controller 5 switches the gate voltage Vn2 of the MOS switch SW2 from the power source voltage VSS to the common power source voltage VMM, and switches the gate voltage Vp3 of the MOS switch SW3 from the power source voltage VDD to the common power source voltage VMM, so that the MOS switch SW2 and the MOS switch SW3 are transited from the off state to the on state.

Accordingly, the output terminal NA of the low voltage side operation amplifier 37A is connected to the data line 31B with the high potential, and the output terminal NB of the high voltage side operation amplifier 37B is connected to the data line 31A with the low potential. At this moment, the output terminal NA is charged through the MOS switch SW2 in the on state. Accordingly, as shown in FIG. 7(F), the potential VA of the output terminal NA of the low voltage side operation amplifier 37A increases.

When the potential VA of the output terminal NA of the low voltage side operation amplifier 37A approaches the common power source voltage VMM, and a gate-source voltage of the MOS switch SW2 becomes lower than a threshold voltage of the MOS switch SW2, the MOS switch SW2 is switched from the on state to the off state, thereby preventing the potential VA from exceeding the common power source voltage VMM. As a result, a bias is not applied to the parasite diode 71 of the output amplifier stage 51A in the forward direction, thereby preventing the bipolar action in the PMOS transistor 62P.

Similarly, after the timing t1, the output terminal NB is discharged through the MOS switch SW3 in the on state. Accordingly, as shown in FIG. 7(E), the potential VB of the output terminal NB of the high voltage side operation amplifier 37B decreases. When the potential VB of the output terminal NB of the high voltage side operation amplifier 37B approaches the common power source voltage VMM, and a gate-source voltage of the MOS switch SW3 exceeds a threshold voltage of the MOS switch SW3, the MOS switch SW3 is switched from the on state to the off state, thereby preventing the potential VB from lowering below the common power source voltage VMM. As a result, a bias is not applied to the parasite diode 70 of the output amplifier stage 51B in the forward direction, thereby preventing the bipolar action in the NMOS transistor 61N.

After the low voltage side operation amplifier 37A outputs the gradation voltage with the negative polarity to the data line 31B through the switch circuit 381A, and the high voltage side operation amplifier 37B outputs the gradation voltage with the positive polarity to the data line 31A through the switch circuit 381B, the switch circuit 381A is switched from the cross connection to the straight connection at a timing t2.

At the timing t2, as shown in FIGS. 7(B) and 7(C), the controller 5 switches the gate voltage Vn2 of the MOS switch SW2 from the common power source voltage VMM to the power source voltage VSS with the low level, and switches the gate voltage Vp3 of the MOS switch SW3 from the common power source voltage VMM to the power source voltage VDD with the high level, so that the MOS switch SW2 and the MOS switch SW3 are transited from the on state to the off state.

At the same time, as shown in FIGS. 7(A) and 7(D), the controller 5 switches the gate voltage Vp1 of the MOS switch SW1 from the power source voltage VDD to the common power source voltage VMM, and switches the gate voltage Vn4 of the MOS switch SW4 from the power source voltage VSS to the common power source voltage VMM, so that the MOS switch SW1 and the MOS switch SW4 are transited from the off state to the on state.

Accordingly, the output terminal NA of the low voltage side operation amplifier 37A is connected to the data line 31A with the high potential, and the output terminal NB of the high voltage side operation amplifier 37B is connected to the data line 31A with the low potential. At this moment, as shown in FIG. 7(F), the potential VA of the output terminal NA of the low voltage side operation amplifier 37A increases. When the potential VA of the output terminal NA of the low voltage side operation amplifier 37A approaches the common power source voltage VMM, and the gate-source voltage of the MOS switch SW4 becomes lower than the threshold voltage of the MOS switch SW4, the MOS switch SW4 is switched from the on state to the off state, thereby preventing the potential VA from exceeding the common power source voltage VMM.

Similarly, after the timing t2, as shown in FIG. 7(E), the potential VB of the output terminal NB of the high voltage side operation amplifier 37B decreases. When the potential VB of the output terminal NB of the high voltage side operation amplifier 37B approaches the common power source voltage VMM, and the gate-source voltage of the MOS switch SW1 exceeds the threshold voltage of the MOS switch SW1, the MOS switch SW1 is switched from the on state to the off state, thereby preventing the potential VB from lowering below the common power source voltage VMM. As a result, a bias is not applied to the parasite diode 71 of the output amplifier stage 51A and the parasite diode 70 of the output amplifier stage 51B in the forward direction, thereby preventing the bipolar action in the PMOS transistor 62P and the NMOS transistor 61N.

As described above, in the liquid crystal display device 1 in the first embodiment, when the switch circuit 381A is switched between the straight connection and the cross connection, the controller 5 controls the gate voltages Vn2 and Vn4 of the MOS switch SW2 and the MOS switch SW4, that are the n-channel type field effect transistors, within the voltage range Δn. Further, the controller 5 controls the gate voltages Vp1 and Vp3 of the MOS switch SW1 and the MOS switch SW3, that are the p-channel type field effect transistors, within the voltage range Δp. Accordingly, it is possible to securely prevent the bipolar action in the low voltage side operation amplifier 37A and the high voltage side operation amplifier 37B.

Second Embodiment

A second embodiment of the present invention will be explained next. In the second embodiment, the liquid crystal display device 1 has a configuration similar to those of the liquid crystal display device 1 in the first embodiment, except a configuration of the switch circuit 381 of the source driver 3 and a control signal supplied to the switch circuit 381.

Figure 8:
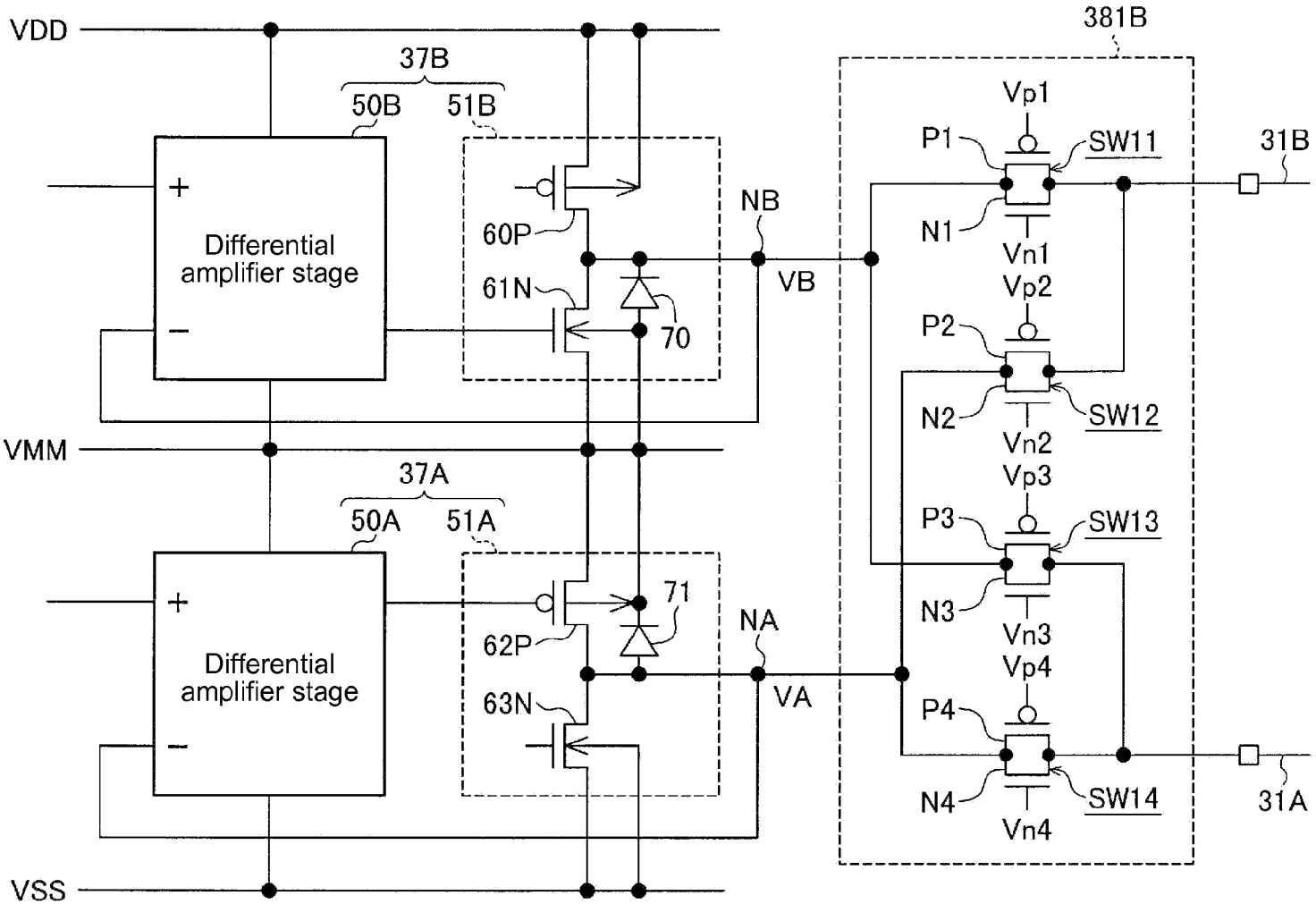
FIG. 8 is a circuit diagram showing a switch circuit of a source driver of a liquid crystal display device according to a second embodiment of the present invention.

FIG. 8 is a circuit diagram showing the switch circuit 381 (381B) of the source driver 3 of the liquid crystal display device 1 according to the second embodiment of the present invention.

As shown in FIG. 8, the switch circuit 381A includes an MOS switch SW11, an MOS switch SW12, an MOS switch SW13, and an MOS switch SW14. The MOS switch SW11 is formed of a pair of a PMOS transistor P1 and an NMOS transistor N1 connected in parallel with each other. The MOS switch SW12 is formed of a pair of a PMOS transistor P2 and an NMOS transistor N2 connected in parallel with each other. The MOS switch SW13 is formed of a pair of a PMOS transistor P3 and an NMOS transistor N3 connected in parallel with each other. The MOS switch SW14 is formed of a pair of a PMOS transistor P4 and an NMOS transistor N4 connected in parallel with each other.

In the embodiment, the MOS switch SW11 is tuned on (an on state or a conductive state) or off (an off state or a non-conductive state) according to levels of gate voltages Vp1 and Vn1 of the PMOS transistor P1 and the NMOS transistor N1. When the MOS switch SW11 is turned on (the on state), the MOS switch SW11 connects the output terminal NB of the high voltage side operation amplifier 37B to the data line 31B. The MOS switch SW12 is tuned on (an on state or a conductive state) or off (an off state or a non-conductive state) according to levels of gate voltages Vp2 and Vn2 of the PMOS transistor P2 and the NMOS transistor N2. When the MOS switch SW12 is turned on (the on state), the MOS switch SW12 connects the output terminal NA of the low voltage side operation amplifier 37A to the data line 31B.

Further, the MOS switch SW13 is tuned on (an on state or a conductive state) or off (an off state or a non-conductive state) according to levels of gate voltages Vp3 and Vn3 of the PMOS transistor P3 and the NMOS transistor N3. When the MOS switch SW13 is turned on (the on state), the MOS switch SW13 connects the output terminal NB of the high voltage side operation amplifier 37B to the data line 31A. The MOS switch SW14 is tuned on (an on state or a conductive state) or off (an off state or a non-conductive state) according to levels of gate voltages Vp4 and Vn4 of the PMOS transistor P4 and the NMOS transistor N4. When the MOS switch SW14 is turned on (the on state), the MOS switch SW14 connects the output terminal NA of the low voltage side operation amplifier 37A to the data line 31A.

Figures 9A, 9B, 9C, 9D, 9E, 9F, 9G, 9H, 9I, 9J:
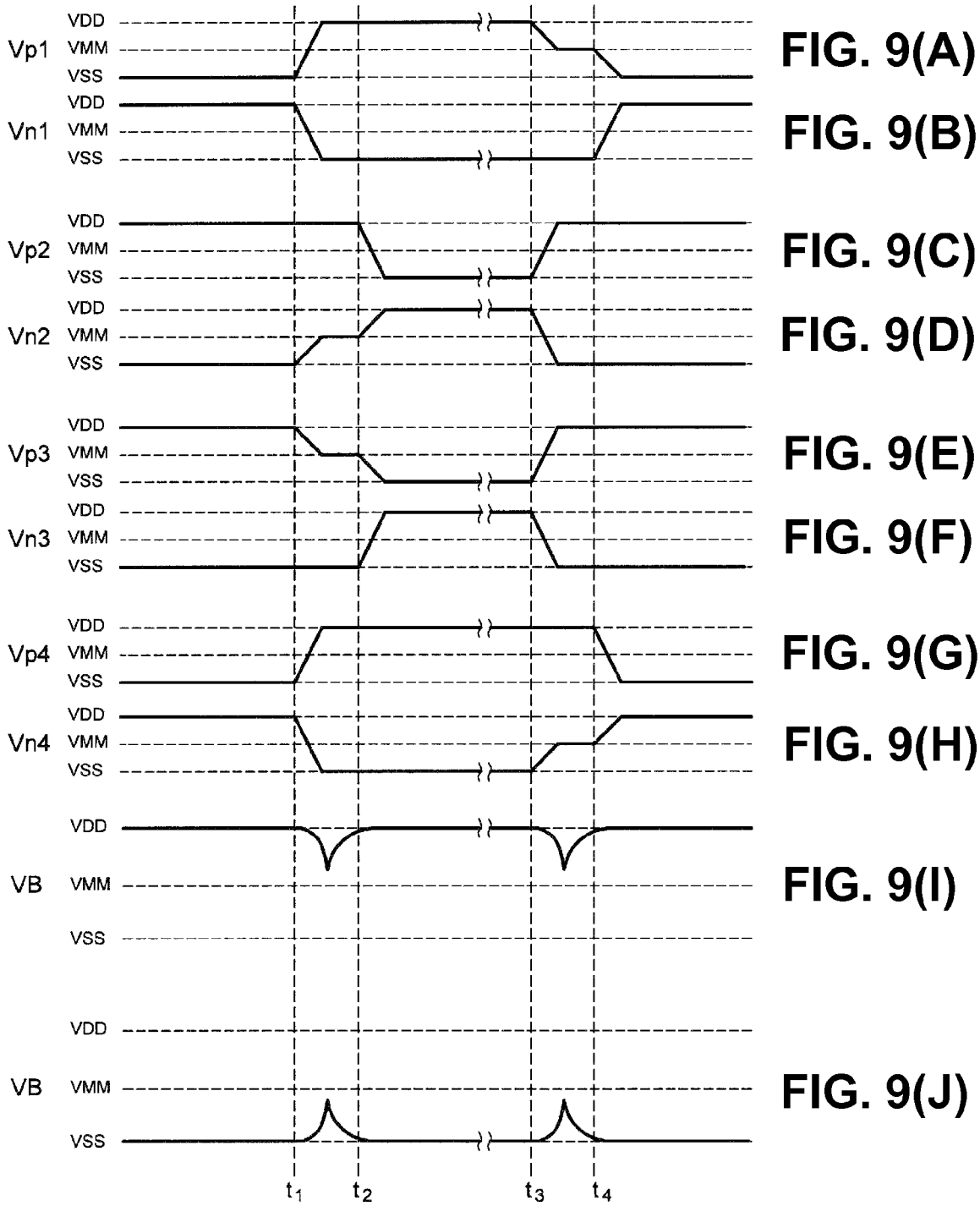
FIGS. 9(A) to 9(J) are timing charts showing a control operation of the source driver of the liquid crystal display device when the switch circuit is switched between a straight connection and a cross connection according to the second embodiment of the present invention.

A control operation of the source driver 3 will be explained next. FIGS. 9(A) to 9(J) are timing charts showing the control operation of the source driver 3 of the liquid crystal display device 1 when the switch circuit 381B is switched between the straight connection and the cross connection according to the second embodiment of the present invention. More specifically, FIGS. 9(A) to 9(H) are graphs showing wave shapes of the gate voltages Vp1, Vn1, Vp2, Vn2, Vp3, Vn3, Vp4 and Vn4 of the MOS switches SW11, SW12, SW13, and SW14, respectively. Further, FIG. 9(I) is a graph showing the potential VB of the output terminal NB of the high voltage side operation amplifier 37B, and FIG. 9(J) is a graph showing the potential VA of the output terminal NA of the low voltage side operation amplifier 37A.

As shown in FIGS. 9(A) to 9(H), the switch circuit 381A is in the straight connection before the timing t1. More specifically, before the timing t1, the controller 5 sets the gate voltages Vp1, Vn2, Vn3, and Vp4 to the power source voltage VSS, and sets the gate voltages Vn1, Vp2, Vp3, and Vn4 to the power source voltage VDD, so that the MOS switch SW11 and the MOS switch SW14 are turned on (the on state), and the MOS switch SW12 and the MOS switch SW13 are turned off (the off state).

As shown in FIGS. 9(A), 9(B), 9(G), and 9(H), at the timing t1, the controller 5 switches the gate voltages Vp1 and Vp4 from the power source voltage VSS to the power source voltage VDD with the high level, and switches the gate voltages Vn1 and Vn4 of the MOS switch SW4 from the power source voltage VDD to the power source voltage VSS with the low level, so that the MOS switch SW11 and the MOS switch SW14 are transited from the on state to the off state.

At the same time, as shown in FIGS. 9(C) and 9(D), at the timing t1, while the controller 5 maintains the gate voltage Vp2 at the power source voltage VDD, the controller 5 switches the gate voltage Vn2 from the power source voltage VSS to the common power source voltage VMM and maintains the gate voltage Vn2 at the common power source voltage VMM, so that the NMOS transistor N2 is transited from the off state to the on state.

At the same time, as shown in FIGS. 9(E) and 9(F), at the timing t1, while the controller 5 maintains the gate voltage Vn3 at the power source voltage VSS, the controller 5 switches the gate voltage Vp3 from the power source voltage VDD to the common power source voltage VMM and maintains the gate voltage Vp3 at the common power source voltage VMM, so that the PMOS transistor P3 is transited from the off state to the on state.

Accordingly, the output terminal NA of the low voltage side operation amplifier 37A is connected to the data line 31B with the high potential, and the output terminal NB of the high voltage side operation amplifier 37B is connected to the data line 31A with the low potential. At this moment, the output terminal NA is charged through the NMOS transistor N2 in the on state. Accordingly, as shown in FIG. 9(J), the potential VA of the output terminal NA of the low voltage side operation amplifier 37A increases.

When the potential VA of the output terminal NA of the low voltage side operation amplifier 37A approaches the common power source voltage VMM, and a gate-source voltage of the NMOS transistor N2 becomes lower than a threshold voltage of the NMOS transistor N2, the NMOS transistor N2 is switched from the on state to the off state, thereby preventing the potential VA from exceeding the common power source voltage VMM. As a result, a bias is not applied to the parasite diode 71 of the output amplifier stage 51A in the forward direction, thereby preventing the bipolar action in the PMOS transistor 62P.

Similarly, after the timing t1, the output terminal NB is discharged through the PMOS transistor P3 in the on state. Accordingly, as shown in FIG. 9(I), the potential VB of the output terminal NB of the high voltage side operation amplifier 37B decreases. When the potential VB of the output terminal NB of the high voltage side operation amplifier 37B approaches the common power source voltage VMM, and a gate-source voltage of the PMOS transistor P3 exceeds a threshold voltage of the PMOS transistor P3, the PMOS transistor P3 is switched from the on state to the off state, thereby preventing the potential VB from lowering below the common power source voltage VMM. As a result, a bias is not applied to the parasite diode 70 of the output amplifier stage 51B in the forward direction, thereby preventing the bipolar action in the NMOS transistor 61N.

At the timing t2, as shown in FIGS. 9(C) and 9(D), the controller 5 switches the gate voltage Vn2 from the power source voltage VDD to the power source voltage VSS, and switches the gate voltage Vn2 from the common power source voltage VMM to the power source voltage VDD. At the same time, as shown in FIGS. 9(E) and 9(F), the controller 5 switches the gate voltage Vn3 from the power source voltage VSS to the power source voltage VDD, and switches the gate voltage Vp3 from the common power source voltage VMM to the power source voltage VSS.

After the low voltage side operation amplifier 37A outputs the gradation voltage with the negative polarity to the data line 31B through the switch circuit 381A, and the high voltage side operation amplifier 37B outputs the gradation voltage with the positive polarity to the data line 31A through the switch circuit 381B, the switch circuit 381A is switched from the cross connection to the straight connection at a timing t3.

At the timing t3, as shown in FIGS. 9(C) to 9(F), the controller 5 switches the gate voltages Vp2 and Vp3 from the power source voltage VSS to the power source voltage VDD, and switches the gate voltages Vn2 and Vn3 from the power source voltage VDD to the power source voltage VSS, so that the MOS switch SW12 and the MOS switch SW13 are transited from the on state to the off state.

At the same time, as shown in FIGS. 9(A) and 9(B), while the controller 5 maintains the gate voltage Vn1 at the power source voltage VSS, the controller 5 switches the gate voltage Vp1 from the power source voltage VDD to the common power source voltage VMM and maintains the gate voltage Vp1 at the common power source voltage VMM, so that the PMOS transistor P1 is transited from the off state to the on state.

At the same time, as shown in FIGS. 9(G) and 9(H), while the controller 5 maintains the gate voltage Vp4 at the power source voltage VDD, the controller 5 switches the gate voltage Vn4 from the power source voltage VSS to the common power source voltage VMM and maintains the gate voltage Vn4 at the common power source voltage VMM, so that the NMOS transistor N4 is transited from the off state to the on state.

Accordingly, the output terminal NA of the low voltage side operation amplifier 37A is connected to the data line 31A with the high potential, and the output terminal NB of the high voltage side operation amplifier 37B is connected to the data line 31B with the low potential. At this moment, the output terminal NA is charged through the NMOS transistor N4 in the on state. Accordingly, as shown in FIG. 9(J), the potential VA of the output terminal NA of the low voltage side operation amplifier 37A increases.

When the potential VA of the output terminal NA of the low voltage side operation amplifier 37A approaches the common power source voltage VMM, and a gate-source voltage of the NMOS transistor N4 becomes lower than a threshold voltage of the NMOS transistor N4, the NMOS transistor N4 is switched from the on state to the off state, thereby preventing the potential VA from exceeding the common power source voltage VMM. As a result, it is possible to prevent the bipolar action in the low voltage side operation amplifier 37A.

Similarly, after the timing t3, the output terminal NB is discharged through the PMOS transistor P1 in the on state. Accordingly, as shown in FIG. 9(I), the potential VB of the output terminal NB of the high voltage side operation amplifier 37B decreases. When the potential VB of the output terminal NB of the high voltage side operation amplifier 37B approaches the common power source voltage VMM, and a gate-source voltage of the PMOS transistor P1 exceeds a threshold voltage of the PMOS transistor P1, the PMOS transistor P1 is switched from the on state to the off state, thereby preventing the potential VB from lowering below the common power source voltage VMM. As a result, it is possible to prevent the bipolar action in the high voltage side operation amplifier 37B.

At a timing t4, as shown in FIGS. 9(A) and 9(B), the controller 5 switches the gate voltage Vn1 from the power source voltage VSS to the power source voltage VDD, and switches the gate voltage Vp1 from the common power source voltage VMM to the power source voltage VSS. At the same time, as shown in FIGS. 9(G) and 9(H), the controller 5 switches the gate voltage Vp4 from the power source voltage VDD to the power source voltage VSS, and switches the gate voltage Vn4 from the common power source voltage VMM to the power source voltage VDD.

As described above, in the liquid crystal display device 1 in the second embodiment, when the switch circuit 381B is switched from the straight connection to the cross connection, the controller 5 controls the gate voltage Vn2 of the NMOS transistor N2, that is the n-channel type field effect transistor, within the voltage range Δn. Further, the controller 5 controls the gate voltage Vp3 of the PMOS transistor P2, that is the p-channel type field effect transistor, within the voltage range Δp.

Further, when the switch circuit 381B is switched from the cross connection to the straight connection, the controller 5 controls the gate voltage Vn4 of the NMOS transistor N4, that is the n-channel type field effect transistor, within the voltage range Δn. Further, the controller 5 controls the gate voltage Vp1 of the PMOS transistor P1, that is the p-channel type field effect transistor, within the voltage range Δp. Accordingly, it is possible to securely prevent the bipolar action in the low voltage side operation amplifier 37A and the high voltage side operation amplifier 37B.

Further, when the switch circuit 381B is switched from the straight connection to the cross connection (after the timing t1), as shown in FIGS. 9(D) and 9(E), after the controller 5 maintains the gate voltage Vn2 of the NMOS transistor N2 at the common power source voltage VMM (the constant level) for a specific period of time, the controller 5 switches the gate voltage Vn2 to the power source voltage VDD higher than the voltage range Δn. At the same time, after the controller 5 maintains the gate voltage Vp3 of the PMOS transistor P3 at the common power source voltage VMM (the constant level) for a specific period of time, the controller 5 switches the gate voltage Vp3 to the power source voltage VSS lower than the voltage range Δp.

Further, when the switch circuit 381B is switched from the cross connection to the straight connection (after the timing t3), as shown in FIGS. 9(D) and 9(E), after the controller 5 maintains the gate voltage Vp1 of the PMOS transistor P1 at the common power source voltage VMM (the constant level) for a specific period of time, the controller 5 switches the gate voltage Vp1 to the power source voltage VSS lower than the voltage range Δp.

At the same time, after the controller 5 maintains the gate voltage Vn4 of the NMOS transistor N4 at the common power source voltage VMM (the constant level) for a specific period of time, the controller 5 switches the gate voltage Vn4 to the power source voltage VDD higher than the voltage range Δn. Accordingly, it is possible to reduce an on-resistance of the MOS transistors of the switch circuit 381B, thereby reducing power consumption of the switch circuit 381B.

Third Embodiment

A third embodiment of the present invention will be explained next. In the third embodiment, the liquid crystal display device 1 has a configuration similar to those of the liquid crystal display device 1 in the second embodiment, except a control signal supplied to the switch circuit 381B of the source driver 3.

FIGS. 10(A) to 10(J) are timing charts showing a control operation of the source driver 3 of the liquid crystal display device 1 when the switch circuit 381B is switched between the straight connection and the cross connection according to the third embodiment of the present invention.

Figures 10A, 10B, 10C, 10D, 10E, 10F, 10G, 10H, 10I, 10J:
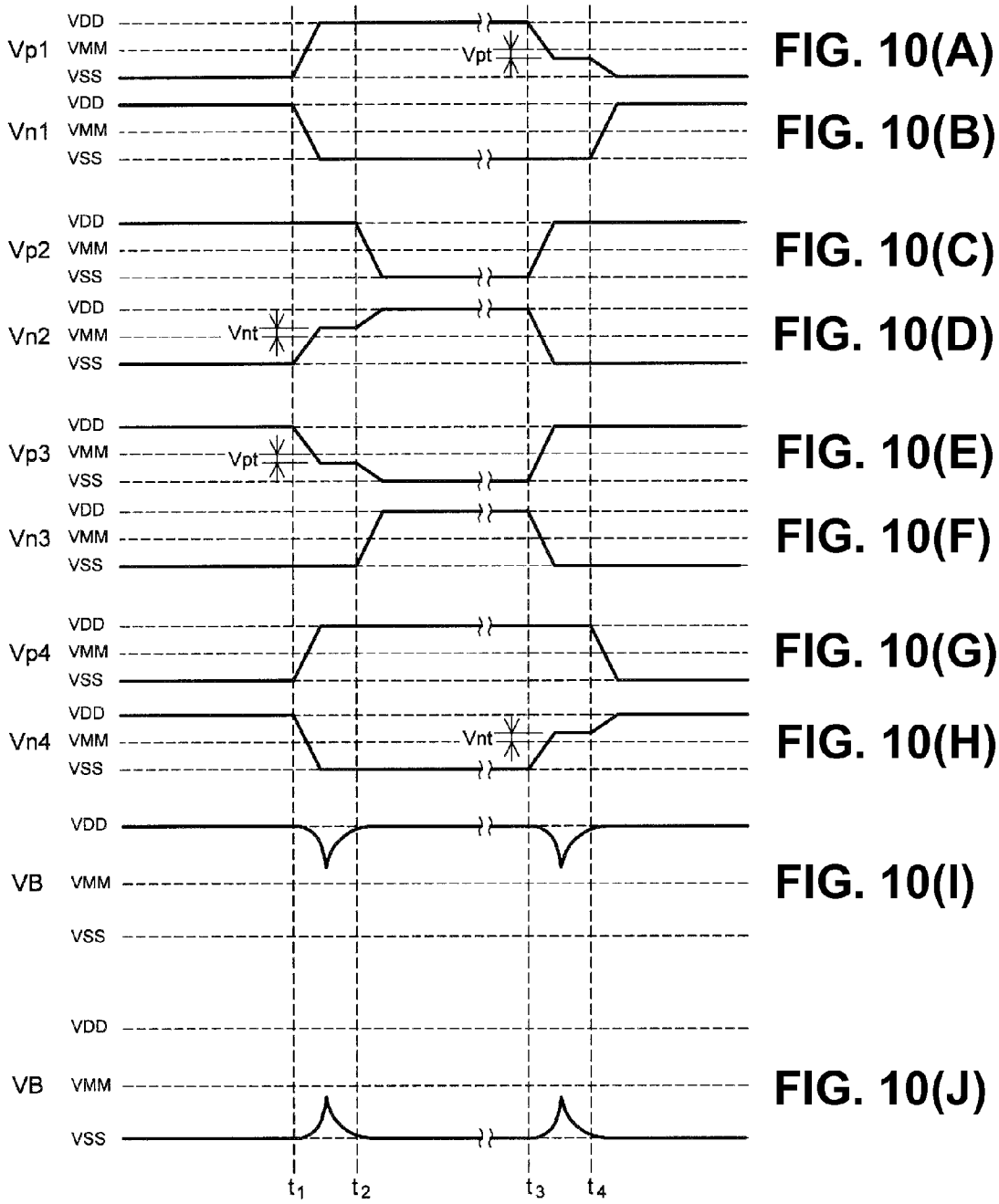
FIGS. 10(A) to 10(J) are timing charts showing a control operation of a source driver of a liquid crystal display device when a switch circuit is switched between a straight connection and a cross connection according to a third embodiment of the present invention.

As shown in FIGS. 10(D) and 10(E), after the timing t1, when the switch circuit 381A is switched from the straight connection to the cross connection, after the controller 5 maintains the gate voltage Vn2 of the NMOS transistor N2 at the upper limit of the voltage range Δn (=VMM+Vnt) for a specific period of time, the controller 5 switches the gate voltage Vn2 to the power source voltage VDD higher than the upper limit of the voltage range Δn. Further, after the controller 5 maintains the gate voltage Vp3 of the PMOS transistor P3 at the lower limit of the voltage range Δp (=VMM−Vpt) for a specific period of time, the controller 5 switches the gate voltage Vp3 to the power source voltage VSS lower than the lower limit of the voltage range Δp.

As shown in FIGS. 10(A) and 10(H), after the timing t3, when the switch circuit 381A is switched from the cross connection to the straight connection, after the controller 5 maintains the gate voltage Vp1 of the PMOS transistor P1 at the lower limit of the voltage range Δp (=VMM−Vpt) for a specific period of time, the controller 5 switches the gate voltage Vp1 to the power source voltage VSS lower than the lower limit of the voltage range Δp. Further, after the controller 5 maintains the gate voltage Vn4 of the NMOS transistor N4 at the upper limit of the voltage range Δn (=VMM+Vnt) for a specific period of time, the controller 5 switches the gate voltage Vn4 to the power source voltage VDD higher than the upper limit of the voltage range Δn. Other gate voltages have wave shapes similar to those shown in FIGS. 9(A) to 9(J).

As described above, in the third embodiment, between the timing t1 and the timing t2, the controller 5 maintains the gate voltage Vn2 of the NMOS transistor N2 at the upper limit of the voltage range Δn (=VMM+Vnt) for a specific period of time, and maintains the gate voltage Vp3 of the PMOS transistor P3 at the lower limit of the voltage range Δp (=VMM−Vpt) for a specific period of time. Further, between the timing t3 and the timing t4, the controller 5 maintains the gate voltage Vp1 of the PMOS transistor P1 at the lower limit of the voltage range Δp (=VMM−Vpt) for a specific period of time, and maintains the gate voltage Vn4 of the NMOS transistor N4 at the upper limit of the voltage range Δn (=VMM+Vnt) for a specific period of time.

Accordingly, as compared with the second embodiment, it is possible to further reduce the on-resistance of the MOS transistors of the switch circuit 381B, thereby further reducing power consumption of the switch circuit 381B.

Fourth Embodiment

A fourth embodiment of the present invention will be explained next. In the fourth embodiment, the liquid crystal display device 1 has a configuration similar to those of the liquid crystal display device 1 in the second embodiment, except a control signal supplied to the switch circuit 381B of the source driver 3.

FIGS. 11(A) to 11(J) are timing charts showing a control operation of the source driver 3 of the liquid crystal display device 1 when the switch circuit 381B is switched between the straight connection and the cross connection according to the fourth embodiment of the present invention. It is noted that the timings t1, t2, t3 and t4 in FIGS. 11(A) to 11(J) do not necessarily correspond to the timings t1, t2, t3 and t4 in FIGS. 9(A) to 9(J) or FIGS. 10 (A) to 10(J).

Figures 11A, 11B, 11C, 11D, 11E, 11F, 11G, 11H, 11I, 11J:
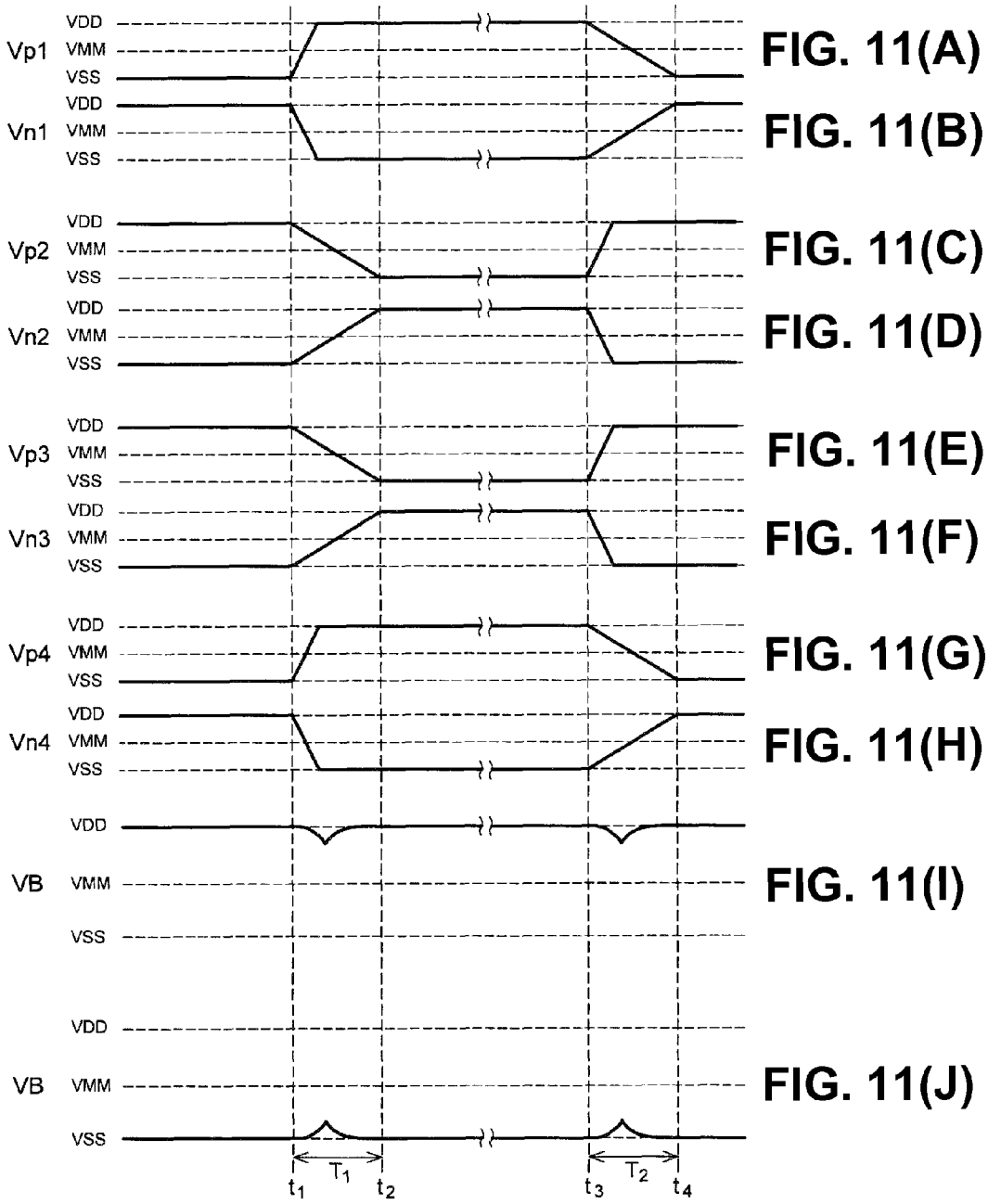
FIGS. 11(A) to 11(J) are timing charts showing a control operation of a source driver of a liquid crystal display device when a switch circuit is switched between a straight connection and a cross connection according to a fourth embodiment of the present invention.

As shown in FIGS. 11(C) and 11(D), between the timing t1 and the timing t2, when the switch circuit 381B is switched from the straight connection to the cross connection, the controller 5 gradually increases the gate voltage Vn2 of the NMOS transistor N2 from the power source voltage VSS to the power source voltage VDD at an increasing rate (a time change rate) less than a specific level in a specific period of time T1. Further, the controller 5 gradually decreases the gate voltage Vp2 of the PMOS transistor P2 from the power source voltage VDD to the power source voltage VSS in the specific period of time T1. Accordingly, the MOS switch SW2 is transited from the non-conductive state to the conductive state.

At the same time, as shown in FIGS. 11(E) and 11(F), the controller 5 gradually decreases the gate voltage Vp3 of the PMOS transistor P3 from the power source voltage VDD to the power source voltage VSS at a decreasing rate (a time change rate) more than a specific level in the specific period of time T1. Further, the controller 5 gradually increases the gate voltage Vn3 of the NMOS transistor N3 from the power source voltage VSS to the power source voltage VDD in the specific period of time T1. Accordingly, the MOS switch SW3 is transited from the conductive state to the non-conductive state.

Accordingly, the output terminal NA of the low voltage side operation amplifier 37A is connected to the data line 31B with the high potential, and the output terminal NB of the high voltage side operation amplifier 37B is connected to the data line 31A with the low potential. At this moment, as shown in FIG. 11(J), the potential VA of the output terminal NA of the low voltage side operation amplifier 37A increases. When the potential VA of the output terminal NA of the low voltage side operation amplifier 37A approaches the common power source voltage VMM, and the gate-source voltage of the NMOS transistor N2 becomes lower than the threshold voltage of the NMOS transistor N2, the NMOS transistor N2 is switched from the on state to the off state, thereby preventing the potential VA from exceeding the common power source voltage VMM.

Similarly, after the timing t1, as shown in FIG. 11(I), the potential VB of the output terminal NB of the high voltage side operation amplifier 37B decreases. When the potential VB of the output terminal NB of the high voltage side operation amplifier 37B approaches the common power source voltage VMM, and the gate-source voltage of the PMOS transistor P3 exceeds the threshold voltage of the PMOS transistor P3, the PMOS transistor P3 is switched from the on state to the off state, thereby preventing the potential VB from lowering below the common power source voltage VMM. As a result, a bias is not applied to the parasite diodes 70 and 71 of the output amplifier stage 51A and the output amplifier stage 51B in the forward direction, thereby preventing the bipolar action in the PMOS transistor 62P and the NMOS transistor 61N.

As shown in FIGS. 11(A) and 11(B), between the timing t3 and the timing t4, when the switch circuit 381B is switched from the cross connection to the straight connection, the controller 5 gradually decreases the gate voltage Vp1 of the PMOS transistor P1 from the power source voltage VDD to the power source voltage VSS at the decreasing rate in a specific period of time T2. Further, the controller 5 gradually increases the gate voltage Vn1 of the NMOS transistor N1 from the power source voltage VSS to the power source voltage VDD in the specific period of time T2. Accordingly, the MOS switch SW1 is transited from the non-conductive state to the conductive state.

At the same time, as shown in FIGS. 11(G) and 11(H), the controller 5 gradually increases the gate voltage Vn4 of the NMOS transistor N4 from the power source voltage VSS to the power source voltage VDD at the increasing rate in the specific period of time T2. Further, the controller 5 gradually decreases the gate voltage Vp4 of the PMOS transistor P4 from the power source voltage VDD to the power source voltage VSS in the specific period of time T1. Accordingly, the MOS switch SW4 is transited from the non-conductive state to the conductive state.

Accordingly, the output terminal NA of the low voltage side operation amplifier 37A is connected to the data line 31A with the high potential, and the output terminal NB of the high voltage side operation amplifier 37B is connected to the data line 31B with the low potential. At this moment, as shown in FIG. 11(J), the potential VA of the output terminal NA of the low voltage side operation amplifier 37A increases. When the potential VA of the output terminal NA of the low voltage side operation amplifier 37A approaches the common power source voltage VMM, and the gate-source voltage of the NMOS transistor N4 becomes lower than the threshold voltage of the NMOS transistor N4, the NMOS transistor N4 is switched from the on state to the off state, thereby preventing the potential VA from exceeding the common power source voltage VMM.

Similarly, after the timing t3, as shown in FIG. 11(I), the potential VB of the output terminal NB of the high voltage side operation amplifier 37B decreases. When the potential VB of the output terminal NB of the high voltage side operation amplifier 37B approaches the common power source voltage VMM, and the gate-source voltage of the PMOS transistor P1 exceeds the threshold voltage of the PMOS transistor P1, the PMOS transistor P1 is switched from the on state to the off state, thereby preventing the potential VB from lowering below the common power source voltage VMM. As a result, a bias is not applied to the parasite diodes 70 and 71 of the output amplifier stage 51A and the output amplifier stage 51B in the forward direction, thereby preventing the bipolar action in the PMOS transistor 62P and the NMOS transistor 61N. Other gate voltages have wave shapes similar to those shown in FIGS. 9(A) to 9(J).

As described above, in the fourth embodiment, in the specific period of time T1, the controller 5 gradually increases the gate voltage Vn2 of the NMOS transistor N2 in an analog fashion, so that the MOS switch SW2 is transited from the non-conductive state to the conductive state. At the same time, the controller 5 gradually decreases the gate voltage Vp3 of the PMOS transistor P3 in the analog fashion, so that the MOS switch SW3 is transited from the conductive state to the non-conductive state.

Further, in the specific period of time T2, the controller 5 gradually increases the gate voltage Vn4 of the NMOS transistor N4 in the analog fashion, so that the MOS switch SW4 is transited from the non-conductive state to the conductive state. At the same time, the controller 5 gradually decreases the gate voltage Vp1 of the PMOS transistor P1 in the analog fashion, so that the MOS switch SW1 is transited from the non-conductive state to the conductive state.

Accordingly, it is possible to securely prevent the bipolar action in the low voltage side operation amplifier 37A and the high voltage side operation amplifier 37B. Further, through adjusting the specific period of time T1 and the specific period of time T2, it is possible to optimize the on resistance of the MOS transistors of the switch circuit 381B while suppressing a current in the parasite diodes 70 and 71 in the forward direction, thereby reducing power consumption.

As described above, the embodiments of the present invention have been explained with reference to the accompanying drawings. The embodiments are just examples of the present invention, and the present invention is applicable to other various modifications. For example, the display pixels DP may be components having a capacitance load other than the liquid crystal display element.

Further, the low voltage side operation amplifier 37A and 37*b* are not limited those in the embodiments, and may have a configuration creating a parasite bipolar transistor between the power source line of the common power source voltage VMM and the output terminal NB, or between the power source line of the common power source voltage VMM and the output terminal NA. Further, the low voltage side operation amplifier 37A and 37*b* may be a rail-to-rail type operation amplifier capable of operating with an input voltage and an output voltage within a range of a power source voltage. Still further, the differential amplifier stage 50A and the differential amplifier stage 50B are not limited those in the embodiments, and may include a circuit of a sink type or a source type.

In the embodiments described above, the low voltage side operation amplifier 37A and 37*b* use the common power source voltage, and may not be limited thereto. For example, the low voltage side operation amplifier 37A may be capable of operating using the power source voltage VSS and the power source voltage VMM1 (VMM1>VSS), and the high voltage side operation amplifier 37B may be capable of operating using the power source voltage VDD and the power source voltage VMM2 (VMM2<VSS, and VMM1 is not equal to VMM2).

In the liquid crystal display device 1 in the embodiment described above, the liquid crystal display panel 2 is driven with the dot inversion method or the line inversion method, and the present invention is not limited thereto. The present invention is applicable to the liquid crystal display device 1 as far as the liquid crystal display device 1 operates in a drive method for switching between states in which each of the display pixels DP holds a gradation voltage with a positive polarity and a gradation voltage with a positive polarity.

The disclosure of Japanese Patent Application No. 2009-298120, filed on Dec. 28, 2009, is incorporated in the application by reference.

While the invention has been explained with reference to the specific embodiments of the invention, the explanation is illustrative and the invention is limited only by the appended claims.

What is claimed is:

1. A drive circuit for driving a display panel having a plurality of scanning lines arranged in parallel to each other; a plurality of data lines arranged to cross the scanning lines and including a first data line and a second data line; and capacitance loads disposed in areas near cross points of the scanning lines and the data lines, comprising:

a first operation amplifier for operating using a first power source voltage and a second power source voltage greater than the first power source voltage to generate an analog voltage with a negative polarity to be supplied to the capacitance loads;

a second operation amplifier for operating using a third power source voltage and a fourth power source voltage greater than the third power source voltage to generate an analog voltage with a positive polarity to be supplied to the capacitance loads;

a control unit for supplying a first control voltage and a second control voltage; and a switch circuit for switching the first operation amplifier from the first data line to the second data line according to the first control voltage, and for switching the second operation amplifier from the second data line to the first data line according to the second control voltage, said switch circuit including an n-channel type field effect transistor for connecting an output terminal of the first operation amplifier to the second data line, wherein said control unit is arranged to apply the first control voltage within a first voltage range smaller than a level greater than the second power source voltage by a threshold voltage of the n-channel type field effect transistor, and greater than the first power source voltage to a gate of the n-channel type field effect transistor, so that the n-channel type field effect transistor transits from a non-conductive state to a conductive state.

2. The drive circuit according to claim 1, wherein said control unit is arranged to maintain the first control voltage at a specific level for a specific period of time.

3. The drive circuit according to claim 2, wherein said control unit is arranged to maintain the first control voltage at the specific level equal to the second power source voltage.

4. The drive circuit according to claim 2, wherein said control unit is arranged to maintain the first control voltage at the specific level equal to an upper limit of the first voltage range.

5. The drive circuit according to claim 1, wherein said control unit is arranged to maintain the first control voltage at a specific level for a specific period of time, and is arranged to apply the first control voltage greater than an upper limit of the first voltage range and smaller than the fourth power source voltage to the gate of the re-channel type field effect transistor after the specific period of time.

6. The drive circuit according to claim 1, wherein said control unit is arranged to gradually increase the first control voltage at a specific increasing rate smaller than a specific level.

7. The drive circuit according to claim 1, wherein said switch circuit further includes a p-channel type field effect transistor for connecting an output terminal of the second operation amplifier to the first data line according to the second control voltage, and said control unit is arranged to apply the second control voltage within a second voltage range greater than a level smaller than the third power source voltage by a threshold voltage of the p-channel type field effect transistor, and smaller than the fourth power source voltage to a gate of the p-channel type field effect transistor, so that the p-channel type field effect transistor transits from a non-conductive state to a conductive state.

8. The drive circuit according to claim 1, wherein said first operation amplifier is arranged to operate using the second power source voltage equal to a common power source voltage, and said second operation amplifier is arranged to operate using the third power source voltage equal to the common power source voltage.

9. A display device comprising the display panel and the drive circuit according to claim 1.

10. The display device according to claim 9, wherein said capacitance load includes a liquid crystal display element, said liquid crystal display element including a liquid crystal layer and opposite electrodes sandwiching the liquid crystal layer, said opposite electrodes being arranged to receive the analog voltage with the positive polarity or the analog voltage with the negative polarity.

11. A drive circuit for driving a display panel having a plurality of scanning lines arranged in parallel to each other; a plurality of data lines arranged to cross the scanning lines and including a first data line and a second data line; and capacitance loads disposed in areas near cross points of the scanning lines and the data lines, comprising:

a first operation amplifier for operating using a first power source voltage and a second power source voltage greater than the first power source voltage to generate an analog voltage with a negative polarity to be supplied to the capacitance loads;

a second operation amplifier for operating using a third power source voltage and a fourth power source voltage greater than the third power source voltage to generate an analog voltage with a positive polarity to be supplied to the capacitance loads;

a control unit for supplying a first control voltage and a second control voltage; and a switch circuit for switching the first operation amplifier from the first data line to the second data line according to the first control voltage, and for switching the second operation amplifier from the second data line to the first data line according to the second control voltage, said switch circuit including a p-channel type field effect transistor for connecting an output terminal of the second operation amplifier to the first data line, wherein said control unit is arranged to apply the second control voltage within a voltage range greater than a level smaller than the third power source voltage by a threshold voltage of the p-channel type field effect transistor, and smaller than the fourth power source voltage to a gate of the p-channel type field effect transistor, so that the p-channel type field effect transistor transits from a non-conductive state to a conductive state.

12. The drive circuit according to claim 11, wherein said control unit is arranged to maintain the second control voltage at a specific level for a specific period of time.

13. The drive circuit according to claim 12, wherein said control unit is arranged to maintain the second control voltage at the specific level equal to the third power source voltage.

14. The drive circuit according to claim 12, wherein said control unit is arranged to maintain the second control voltage at the specific level equal to a lower limit of the voltage range.

15. The drive circuit according to claim 11, wherein said control unit is arranged to maintain the second control voltage at a specific level for a specific period of time, and is arranged to apply the second control voltage smaller than a lower limit of the voltage range and greater than the first power source voltage to the gate of the p-channel type field effect transistor after the specific period of time.

16. The drive circuit according to claim 11, wherein said control unit is arranged to gradually increase the second control voltage at a specific increasing rate smaller than a specific level.

17. The drive circuit according to claim 11, wherein said first operation amplifier is arranged to operate using the second power source voltage equal to a common power source voltage, and said second operation amplifier is arranged to operate using the third power source voltage equal to the common power source voltage.

18. A display device comprising the display panel and the drive circuit according to claim 11.

19. The display device according to claim 18, wherein said capacitance load includes a liquid crystal display element, said liquid crystal display element including a liquid crystal layer and opposite electrodes sandwiching the liquid crystal layer, said opposite electrodes being arranged to receive the analog voltage with the positive polarity or the analog voltage with the negative polarity.

* * * * *